US011857827B2

(12) United States Patent
Anderson et al.

(10) Patent No.: US 11,857,827 B2
(45) Date of Patent: Jan. 2, 2024

(54) PLATE-SENSING BASE FOR A CONNECTED ADJUSTABLE FREE WEIGHT SYSTEM

(71) Applicant: NAUTILUS, INC., Vancouver, WA (US)

(72) Inventors: Todd D. Anderson, Brush Prairie, WA (US); Jeffrey A. Tracy, Troutdale, OR (US); Ryan J. Pohl, Camas, WA (US); Hongxiang Ji, Shanghai (CN)

(73) Assignee: Nautilus, Inc., Vancouver, WA (US)

( * ) Notice: Subject to any disclaimer, the term of this patent is extended or adjusted under 35 U.S.C. 154(b) by 258 days.

(21) Appl. No.: 17/531,435

(22) Filed: Nov. 19, 2021

(65) Prior Publication Data

US 2023/0158357 A1 May 25, 2023

(51) Int. Cl.
*A63B 21/075* (2006.01)
*A63B 21/072* (2006.01)
(Continued)

(52) U.S. Cl.
CPC ..... *A63B 21/075* (2013.01); *A63B 21/0726* (2013.01); *A63B 21/0728* (2013.01);
(Continued)

(58) Field of Classification Search
CPC ..... A63B 21/072–075; A63B 21/0726; A63B 21/0728; A63B 24/0062; A63B 71/0036;
(Continued)

(56) References Cited

U.S. PATENT DOCUMENTS 5,210,706 A 5/1993 Nishiyama
5,857,939 A 1/1999 Kaufman
(Continued)

FOREIGN PATENT DOCUMENTS

CN 1077021 A 10/1993
CN 2471358 Y 1/2002
(Continued)

OTHER PUBLICATIONS

"International Search Report and Written Opinion for PCT/US2022/079913, dated Mar. 2, 2023".
(Continued)

*Primary Examiner* — Loan B Jimenez
*Assistant Examiner* — Catrina A Letterman
(74) *Attorney, Agent, or Firm* — Dorsey & Whitney LLP

(57) ABSTRACT

A sensing base for an adjustable free weight may include a cradle, and a sensing assembly, which includes a plurality of sensors and mechanical components (e.g., pivoting levers), each associated with a respective plate well that accommodates a weight plate of the adjustable free weight such that each mechanical component actuates the state of a respective sensor upon placement or removal of the weight in a plate well. Sensor signals reflecting the states of the sensors are communicated, via a circuit, a processor to determine the weight selection of the adjustable free weight when removed from the base. The sensing assembly may be implemented using individual sensors of a variety of different types such as hall effect sensors, optical interrupt sensors, IR optical sensors, and the like. The base may be configured to automatically communicate the determined weight to an external computing device to facilitate activity tracking and/or fitness coaching.

21 Claims, 15 Drawing Sheets

(51) Int. Cl.
*A63B 24/00* (2006.01)
*A63B 71/00* (2006.01)

(52) U.S. Cl.
CPC ..... *A63B 24/0062* (2013.01); *A63B 71/0036* (2013.01); *A63B 2209/08* (2013.01); *A63B 2220/833* (2013.01); *A63B 2225/50* (2013.01)

(58) Field of Classification Search
CPC ..... A63B 2209/08; A63B 2220/833; A63B 2225/50; A63B 71/0622; A63B 2220/805; A63B 2225/74
See application file for complete search history.

(56) References Cited

U.S. PATENT DOCUMENTS 6,014,078 A 1/2000 Rojas et al.
6,033,350 A 3/2000 Krull
D422,654 S 4/2000 Chen
6,099,442 A 8/2000 Krull
6,261,022 B1 7/2001 Dalebout et al.
6,322,481 B1 11/2001 Krull
6,402,666 B2 6/2002 Krull
6,416,446 B1 7/2002 Krull
6,540,650 B1 4/2003 Krull
6,629,910 B1 10/2003 Krull
6,632,159 B1 10/2003 Slattery
6,669,606 B2 12/2003 Krull
6,679,816 B1 1/2004 Krull
6,719,674 B2 4/2004 Krull
6,733,424 B2 5/2004 Krull
6,746,381 B2 6/2004 Krull
6,749,547 B2 6/2004 Krull
6,793,607 B2 9/2004 Neil
D498,272 S 11/2004 Sanford-Schwentke et al.
6,855,097 B2 2/2005 Krull
6,872,173 B2 3/2005 Krull
6,896,645 B1 5/2005 Krull
6,899,661 B1 5/2005 Krull
D508,628 S 8/2005 Crawford et al.
6,949,052 B2 9/2005 Millington et al.
6,974,405 B2 12/2005 Krull
6,997,856 B1 2/2006 Krull
7,060,011 B1 6/2006 Krull
7,066,867 B2 6/2006 Krull
7,077,790 B1 7/2006 Krull
D528,173 S 9/2006 Flick et al.
D528,611 S 9/2006 Flick et al.
7,128,696 B1 10/2006 Krull
7,128,697 B1 10/2006 Krull
7,153,243 B1 12/2006 Krull
D540,405 S 4/2007 Crawford et al.
D540,894 S 4/2007 Crawford et al.
7,264,578 B1 9/2007 Krull
7,291,098 B1 11/2007 Krull
7,300,390 B1 11/2007 Krull
7,387,597 B2 6/2008 Krull
7,455,621 B1 11/2008 Anthony
7,470,216 B2 12/2008 Farinelli et al.
D584,086 S 1/2009 Gettle
7,497,813 B1 3/2009 Krull
7,497,814 B1 3/2009 Krull
7,547,268 B1 6/2009 Krull
7,578,771 B1 8/2009 Towley, III et al.
7,588,520 B2 9/2009 Nalley
7,604,577 B2 10/2009 Lin
7,608,021 B1 10/2009 Nalley
7,614,982 B2 11/2009 Crawford et al.
7,614,983 B1 11/2009 Krull
7,621,855 B1 11/2009 Krull
7,625,322 B1 12/2009 Krull
7,648,448 B2 1/2010 Krull
D610,636 S 2/2010 Golesh et al.
7,678,030 B2 3/2010 Savage
D617,854 S 6/2010 Gettle
7,794,359 B1 9/2010 Lannon et al.
7,874,958 B1 1/2011 Ramsey, Sr.
D639,358 S 6/2011 Rauwerdink
D639,359 S 6/2011 Rauwerdink
7,981,012 B1 7/2011 Krull
D643,481 S 8/2011 Rauwerdink
8,002,680 B2 8/2011 Crawford et al.
8,007,415 B1 8/2011 Lundquist
8,038,576 B2 10/2011 Farinelli et al.
8,075,458 B2 12/2011 Nalley
8,105,207 B1 1/2012 Lannon et al.
8,105,209 B2 1/2012 Lannon et al.
8,217,797 B2 7/2012 Ikoyan
8,287,438 B2 10/2012 Krull
8,337,364 B2 12/2012 Ishii et al.
8,747,282 B2 6/2014 Lannon et al.
8,749,380 B2 6/2014 Vock et al.
8,913,134 B2 12/2014 Goree et al.
8,932,188 B2 1/2015 Svenberg
9,126,072 B2 9/2015 Watterson
9,814,922 B2 * 11/2017 Moran ..... A63B 21/0726
2002/0128127 A1 9/2002 Chen
2003/0148862 A1 8/2003 Chen et al.
2005/0065003 A1 3/2005 Klotzki
2005/0227831 A1 10/2005 Mills et al.
2006/0084422 A1 4/2006 Huang et al.
2009/0186748 A1 7/2009 Golesh et al.
2010/0184570 A1 7/2010 Cheng
2010/0304938 A1 12/2010 Olson
2010/0304940 A1 12/2010 Svenberg et al.
2012/0115689 A1 5/2012 Dalebout et al.
2012/0309597 A1 12/2012 Liu
2013/0090212 A1 4/2013 Wang
2013/0171599 A1 7/2013 Bleich et al.
2013/0028859 A1 10/2013 Watterson
2013/0288859 A1 10/2013 Watterson
2014/0235409 A1 8/2014 Salmon et al.
2014/0243168 A1 8/2014 Razzaq
2014/0248996 A1 9/2014 Adel
2014/0274596 A1 9/2014 Krull
2014/0349820 A1 11/2014 Wang
2016/0107062 A1 4/2016 Zimmerman et al.
2016/0184623 A1 * 6/2016 Moran ..... A63B 21/075 482/8
2016/0346617 A1 12/2016 Srugo et al.
2017/0001061 A1 * 1/2017 Marjama ..... A63B 71/0036
2017/0252599 A1 * 9/2017 Wang ..... A63B 21/0726
2018/0353794 A1 * 12/2018 Wang ..... A63B 71/0036
2019/0388724 A1 * 12/2019 Polinsky ..... A63B 24/0087
2022/0212052 A1 * 7/2022 Ercanbrack ..... A63B 71/0036
2022/0355163 A1 11/2022 Aly et al.
2022/0409945 A1 12/2022 Bhandarkar et al.

FOREIGN PATENT DOCUMENTS

CN 201482056 U 5/2010
CN 203224287 U 10/2013
CN 108126305 A 6/2018
EP 2586502 A1 5/2013
WO 2009013679 A2 1/2009
WO 2009070083 A1 6/2009
WO 2013151770 10/2013

OTHER PUBLICATIONS

International Search Report and Written Opinion for international application PCT/US15/67328 dated Feb. 26, 2016, 11 pages.
International Search Report and Written Opinion for PCT/US2014/059189, dated Mar. 13, 2015, 8 pages.
Internaitonal Search Report and Written Opinion dated Jan. 14, 2015, for PCT/US2014/059075, 8 Pages.
International Search Report and Written Opinion, dated Jan. 15, 2015, for PCT/US14/59192, 10 Pages.

* cited by examiner

1300

| | U /I | COLOR | BEHAVIORS | STATES |
|---|---|---|---|---|
| 1302 | | (N /A) | OFF | LOW POWER /SLEEP ~OR~ AWAKE /PAIRED BUT CONSERVING BATTERY POWER (LED HAS TIMED OUT) |
| 1304 | | WHITE | SOLID | AWAKE, NOT CONNECTED |
| 1306 | | WHITE | BLINKING | IN PAIRING MODE /DISCOVERABLE |
| 1308 | | BLUE | SOLID | SUCCESSFULLY PAIRED AND READY FOR WORKOUT |
| 1310 | | RED (LOW BATTERY LED ONLY) | BLINKS 3–4 RED FLASHES | BATTERY IS LOW |

PLATE-SENSING BASE FOR A CONNECTED ADJUSTABLE FREE WEIGHT SYSTEM

FIELD

The present disclosure relates generally to a plate-sensing base which optionally includes a communication interface to provide a connected base for a weight-selectable (or adjustable) free weight system, such as an adjustable dumbbell or barbell system.

BACKGROUND

Adjustable dumbbells and barbells, collectively referred to as adjustable free weights, include a handle to which multiple weight plates (or simply weights or plates) are selectively attached. A user may select, via a selection mechanism of the adjustable free weight, the weight of the adjustable free weight for a given exercise, and the appropriate coupling and decoupling of weight plates to the handle may occur automatically as a result to the user's selection. Such adjustable free weight systems obviate the need for multiple sets of free weights in the case of dumbbells, and can make exercising more efficient by eliminating the need for a user to manually add and remove plates from the ends of the handle/bar of a barbell. Weight plates not used to make up the desired exercise weight, also referred to as unused weight plates, are decoupled from the handle. The adjustable free weight is typically supported in a base structure (or simply base), which holds the free weight (e.g., the dumbbell or barbell) when not in use. The base also supports the decoupled (or unused) weight plates when the free weight is removed from the base. The total weight of the free weight, when used during exercise, is determined by the combination of individual weight plates attached to the handle thereof, which combination may vary depending on user selection via the weight-selection mechanism. Designers and manufacturers of exercise equipment continue to make improvements to adjustable free weight systems to further enhance the user experience.

SUMMARY

Examples of a plate-sensing base for an adjustable free weight system, such as a weigh-selectable dumbbell or barbell system, are described herein. The adjustable free weight supported on the base includes a plurality of weight plates which are selectively and automatically attachable, via operation of a selection mechanism of the free weight, to a handle assembly (or simply handle) of the free weight, e.g., to the opposite ends of the handle. In some embodiments, the adjustable free weight system is an adjustable barbell system. In other embodiments, the adjustable free weight system is an adjustable dumbbell system, which may include a pair of dumbbells. The adjustable free weight of the examples herein may be supported, when not in use, on a plate-sensing base. The plate-sensing base includes a support cradle (or simply cradle), which provides at least one recess which receives the free weight at least partially therein, such as when the free weight is not in use. The recess defines a set of plate wells that receive or accommodate a portion of each weight plate when the adjustable free weight is rested on the base. The plate wells are configured to support the individual weight plate generally vertically when a plate is left in the base (i.e. when decoupled from the handle and the handle is removed). For example, the plate wells may be defined, at least in part, by generally vertically extending positioning walls, which support the plates in the generally vertical position. In some embodiments, the adjustable free weight is of a configuration where the weight plates are grouped into first and second set of weights on the opposite ends of the handle. In such embodiments, the base is similarly configured to define corresponding first and second recesses on the opposite lateral sides of the base, each of which includes a suitable number of plate wells that corresponds to the number of plates of the free weight (e.g., dumbbell or barbell) to be supported on the base.

The base is configured to detect the presence or absence of a weight plate on the base, and the weight selection of the free weight is determined from signal(s) indicative of the presence or absence of a weight plate on the base. The base according to the present disclosure includes a plate-sensing assembly which detects the presence or absence of individual weight plates on the base when the free weight handle is removed from the base. The weight of the adjustable free weight may then be determined based on the weights remaining on the base and/or communicated, in some cases automatically upon removal of the handle from the base, to an external computing device (e.g., the user's smart phone). In some embodiments, the plate-sensing assembly includes a combination of mechanical components (e.g., a biased rigid member arranged to translate or pivot when depressed by a weight plate) which cooperates with one or more sensors of a sensor assembly for detecting the presence or absence of individual weight plates on the base. The states of each sensor may be communicated, via one or more signals generated by a circuit to which each sensor is electrically coupled, to a processor. The processor determines, based on the states of each sensor, the combination of plates remaining in the base upon removal of the handle from the base, and consequently the weights attached and thus the total weight of the free weight when removed from the base. The processor may be located in the base or in a separate computing device (e.g., the user's smartphone or another computing device). In some embodiments, the plate-sensing base may be configured to communicatively (e.g., wirelessly) couple to one or more external computing devices, such as the user's smart phone, for communicating to the external device, in some cases automatically, the determined weight of the free weight (e.g., dumbbell). The weight-sensing base may thus be referred to as a connected (or smart) base and may thus provide a smart or connected adjustable free weight system. The external computing device may be any suitable computing device such as a personal mobile device (e.g., a smart phone or tablet), a smart TV, or smart display of a coaching system, which by receiving the weight selection(s) from the smart base may be adapted for exercise tracking or fitness coaching.

Combinations of the inventive subject matter according to the present disclosure include, but not limited, to the below enumerated paragraphs:

A1. A base for an adjustable free weight having a handle and a plurality of weight plates selectively removably attached to the handle, the base comprising:

- a cradle configured to support the adjustable free weight when not in use, wherein the cradle defines a plurality of plate wells, each of which is configured to accommodate an individual one of the plurality of weight plates; and
- a plate-sensing assembly attached to the cradle, the plate sensing assembly comprising a plurality of rigid members, each including a plunger, wherein each of the plurality of rigid members is movably coupled to the cradle to move between a first position and a second position in which the plunger protrudes into a respective plate well by a smaller amount than when the rigid member is in the first position, the plate-sensing assembly further comprising a corresponding plurality of sensors, each associated with a respective rigid member whereby movement of the rigid member changes a state of the sensor, and at least one circuit configured to generate one or more signals indicative of the states of the plurality sensors and to transmit the one or more signals to a processor for determining a weight of the adjustable free weight when removed from the base.

A2. The base according to paragraph A1, wherein each of the plurality of rigid members is biased toward its first position.

A3. The base according to paragraphs A1 or A2, wherein each of the plurality of rigid members comprises a lever pivotally coupled to the cradle.

A4. The base according to paragraph A3, wherein the plate-sensing assembly further comprise a support structure coupled to an underside of the cradle, and wherein each of the levers comprises an axle transversely oriented relative to a lengthwise direction of the lever and rotatably received in a corresponding channel defined by the support structure.

A5. The base according to paragraphs A3 or A4, wherein each of the levers further comprises a spring housing aligned with the plunger and configured to accommodate at least a portion of a spring biasing the lever towards its first position.

A6. The base according to any of paragraphs A3-A5, wherein the plunger, the axle and the spring housing of each lever is integrally formed with the lever.

A7. The base according to any of paragraphs A1-A6, wherein each of the plurality of sensors is a hall effect sensor, and wherein the base further comprises a corresponding plurality of magnets, each fixed to a respective one of the rigid members to move, with the respective rigid member, between the first and second positions.

A8. The base according to paragraph A7, wherein each of the hall effect sensors are positioned to generate higher output voltage when a corresponding rigid member is in its first position.

A9. The base according to any of paragraphs A1-A6, wherein each of the plurality of sensors is an optical interrupt sensor comprising a light source and an optical receiver positioned on opposite sides of a respective rigid member to form a beam path between the light source and the optical receiver, and wherein each of the plurality of rigid members comprises a second portion that extends to a location in the beam path when the rigid member is in either the first position or the second position.

A10. The base according to paragraph A9, wherein the first portion extends from the rigid member in a first direction into a respective plate well, and wherein the second portion extends from the rigid member in a second direction substantially perpendicular to the first direction.

A11. The base according to any of paragraphs A1-A6, wherein each of the plurality of sensors is an optical sensor comprising a light source configured to transmit a beam along a beam path and wherein a second portion of the rigid member extends into the beam path when the rigid member is either the first position or the second position, the optical sensor further comprising a receiver located on a same side of the rigid member as the light source.

A12. The base according to any of paragraphs A1-A6, wherein each of the plurality of sensors comprises a resistor and wherein each of the rigid member is formed of an electrically conductive material and is arranged to make contact with an electrical contact of the respective resistor when the rigid member is in the first position A13. The base according to any of paragraphs A1-A12 further comprising a switch configured to activate a sensing function of the base.

A14. The base according to paragraph A13, wherein the switch is operatively coupled to at least one of: a button configured for actuation by a user; and an activation member configured to be automatically actuated by removal of the handle from the base.

A15. The base according to paragraph A14, wherein the activation member comprises a pivoting lever positioned below an underside of the cradle and penetrating, through an opening of the cradle, to a user-facing side of the cradle.

A16. The base according to paragraph A15, wherein the pivoting lever is a first pivoting lever biased by a spring towards the user-facing side of the cradle, the activation member further comprising a second pivoting lever between the spring and the first pivoting lever A17. The base according to any of paragraphs A14-A16 further comprising a user interface including at least one of the button and a status light configured to indicate a status of the base.

A18. The base according to paragraph A17, wherein the status light is configured to indicate at least one of an operational mode of the base, a pairing status of the base, and a power level of the base.

A19. The base according to paragraph A17 or A18 further comprising a wireless communication interface operatively associated with the button for selectively pairing the base with an external computing device separate from the base and the adjustable free weight.

B1. An adjustable free weight system comprising an adjustable dumbbell having a handle and a plurality of weight plates selectively removably attached to the handle; and a base comprising:

a cradle configured to support the handle and the plurality of weight plates when not in use, wherein the cradle defines a plurality of plate wells, each of which is configured to accommodate an individual one of the plurality of weight plates;

a sensing assembly attached to the cradle and comprising a plurality of pivoting levers, each having a plunger that protrudes into a respective one of the plurality of plate wells, a corresponding number of sensors, each operatively arranged to interact with a respective lever, and a circuit configured to detect a change in a state of each of the plurality of sensors in response to movement of one or more of the plurality of levers and to generate one or more signals indicative of the state of the plurality of the sensors; and at least one processor configured to determine, based on the one or more signals, a total weight of the adjustable dumbbell upon removal of the handle from the base.

B2. The adjustable free weight system according to paragraph B1, wherein each of the plurality of sensors is a hall effect sensor or an optical sensor.

Other combinations of the inventive subject matter disclosed herein is described and will become apparent with further reference to the figures and detailed description below.

BRIEF DESCRIPTION OF THE DRAWINGS

The accompanying drawings, which are incorporated in and constitute a part of the specification, illustrate examples of the disclosure and, together with the general description given above and the detailed description given below, serve to explain the principles of these examples.

DETAILED DESCRIPTION

Figure 1:
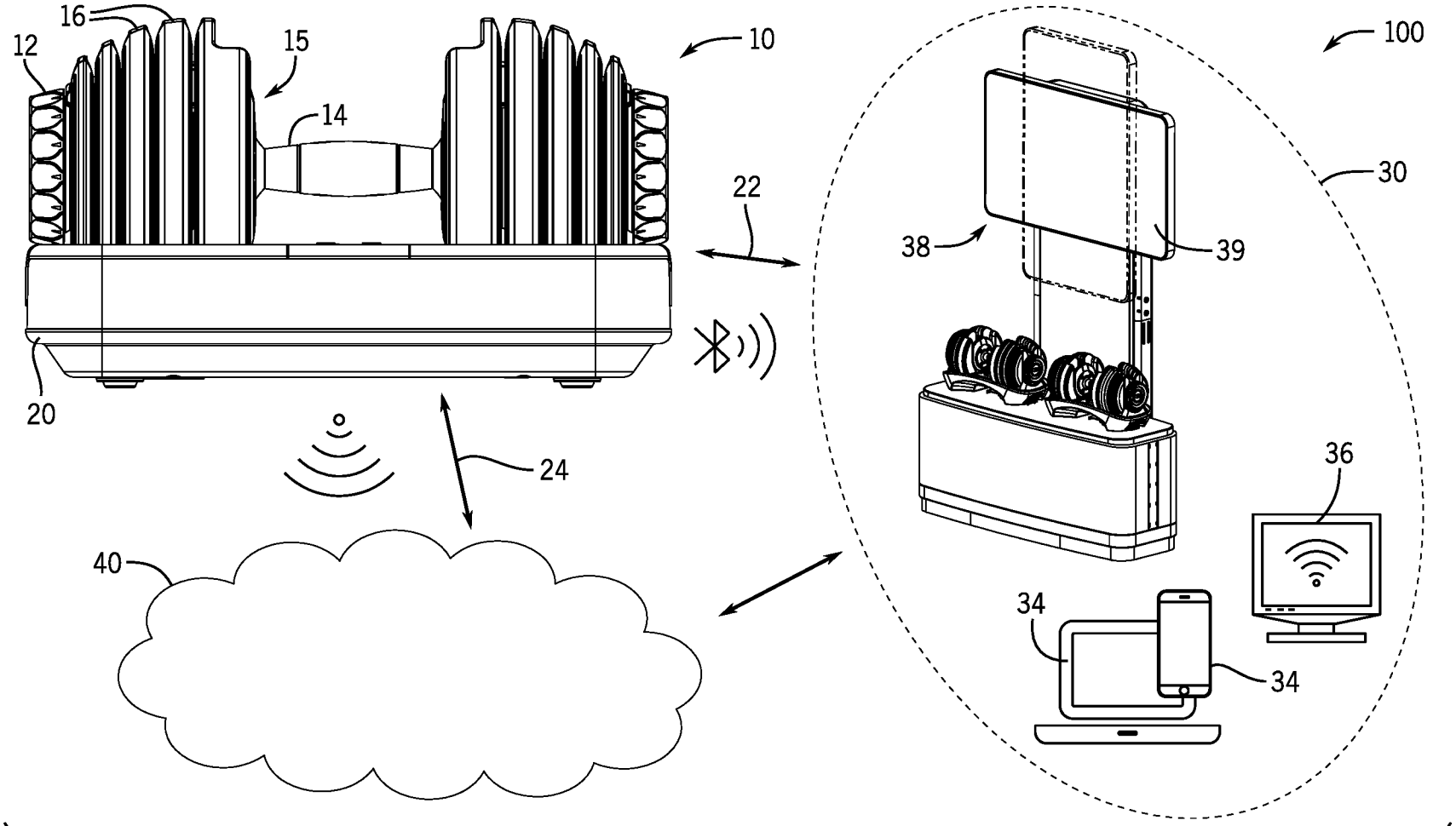
FIG. 1 shows an illustration of an adjustable dumbbell with a connected base in an operational environment according to some embodiments herein.

Examples of a plate-sensing base for a weight-selectable or adjustable free weight (e.g., an adjustable dumbbell or barbell) are described, which may be provided (e.g., to a user) as an exercise system together with the adjustable free weight (e.g., dumbbell or barbell). An adjustable dumbbell or barbell may include a handle assembly and a plurality of weight plates, selectively attachable to the handle, e.g., to opposite ends thereof. The plurality of weight plates and the handle assembly may be configured such that each of the plurality of weight plates can be selectively coupled to and decoupled from the handle assembly through the operation of a selection mechanism. The base is configured to support the adjustable free weight and/or the individual weight plates when not in use. For example, the base may include a support cradle (or simply cradle), which provides at least one recess in which the free weight is placed when not in use. The recess defines a set of plate wells that receive/accommodate a portion of each weight plate when the adjustable free weight is rested on the base. The plate wells are configured to support the individual weight plates generally vertically when in the base (i.e., when not in use). In some embodiments, the adjustable free weight may be an adjustable dumbbell, which may be implemented according to any of the examples in U.S. Pat. No. 7,261,678, entitled "Adjustable Dumbbell System," and U.S. Pat. No. 10,518,123, entitled "Adjustable Dumbbell System," the contents of which are incorporated by reference herein in their entirety for any purpose. In other embodiments, the adjustable free weight may be an adjustable barbell, which may be implemented according to any of the examples in U.S. Pub. App. No. 2020/0306578, entitled "Adjustable Barbell System," the content of which is incorporated by reference herein in its entirety for any purpose. In some embodiments, the exercise system described herein includes at least one plate-sensing base and at least one adjustable free weight (e.g., an adjustable dumbbell or barbell). In some embodiments, the exercise system includes a pair of plate-sensing bases and adjustable free weights (e.g., a pair of adjustable dumbbells). In some embodiments, the exercise system includes a single plate sensing base and corresponding set of weights, together with multiple, differently shaped handle assemblies (e.g., a straight bar, a curl bar, etc.) for an adjustable barbell system.

The plate-sensing base of the present disclosure includes a plate sensing assembly for detecting the presence or absence of individual weight plates in the base when the handle is removed, and thus determining the weight of the free weight when removed from the base. In some embodiments, the base is equipped with a communication interface and is configured to communicate to an external computing device, in some cases automatically upon removal of the handle from the base, the identified plates on the base and/or the determined weight of the free weight. In some embodiments, the plate-sensing mechanism is implemented using a combination of mechanical components (e.g., rigid members such as translating or pivoting levers/arms) which cooperate with one or more sensors of a sensor assembly. Each of the mechanical components has a portion extending into an individual plate well and is biased to extend into the plate well. The individual weights, when placed into their respective plate wells, interact with the respective mechanical component (e.g., actuate the rigid member against the biasing force), which movement in turn communicates to a processor, via the sensor(s) associated with the mechanical components, the presence or absence of weights in the plate wells.

In some embodiments, the plate-sensing base is configured to communicatively couple to one or more external computing devices to communicate the determined weight of the dumbbell to the external computing device(s). Such a plate-sensing base may thus also be referred to as a connected (or smart) base and may be provided as part of a smart or connected adjustable free weight system. The external computing device may be any computing device of the user of the adjustable free weight, such as a personal mobile device (e.g., a tablet or a smartphone), a laptop, a smart TV or any other computing system that receives the weight selection(s) from the smart base for use in exercise tracking or fitness coaching. FIG. 1 is an illustration of an adjustable dumbbell 10 with a connected base 20 in an exemplary operational environment according to the present disclosure. The adjustable dumbbell 10 and the connected base 20 may be part of a free weight exercise system 100 in which the base 20 is configured to communicate with an external computing device 30. While only a single dumbbell is shown, the free-weight exercise system 100 may include a set of free-weights, e.g., a pair of dumbbells as are shown as part of the fitness coaching system 38. Also, while the free weight is illustrated as a dumbbell in the exemplary system 100, in other examples the free weight system 100 may include a different type of free weight such as an adjustable barbell. The connected (or smart) base 20 is configured to support the free weight (e.g., dumbbell 10) when not in use. The free weight (e.g., dumbbell 10) includes a handle grip 14 operatively associated with a weight selection mechanism 12 forming a handle assembly 15 to which one or more of the weight plates 16 are selectively attachable, based on a selection made by the user via the weight selection mechanism 12. The base 20 is configured to support any weight plates 16 of the free weight (e.g., dumbbell 10) that are not attached to the handle assembly 15 when the handle assembly 15 is removed from the base, e.g., when picked up by the user for performing exercise.

The connected base 20 is configured to communicate with one or more external computing device(s) 30. By "external" when describing the one or more computing devices 30 it is implied that the components thereof (e.g., the processor(s), display(s), memory, communication link(s), etc.) are not part of (e.g., integrated into) the adjustable free weight (e.g., the dumbbell) and its base. The external computing device(s) 30 with which the base 20 communicatively couples may have various other separate and/or unrelated uses to that associated with the smart base 20. The external computing device 30 may be any type of portable computing/communication device (e.g., a laptop 32, a tablet, or a smart phone 34, etc.). The external computing 30 device may, in some embodiments, be a smart/connected TV 36 or a smart/connected display 39 of a fitness/coaching system 38 or other fitness system such as a stationary exercise machine (e.g., an elliptical machine, a stationary bike, etc.) equipped with a display console. The external computing device(s) 30 may be any other suitable computing device(s) that includes at least one processor, display(s) and communication link(s) for receiving and displaying information based on signals from the base 20, e.g., for enhancing the user's exercise experience.

In some embodiments, the smart base 20 is configured to communicate directly with the external computing device(s) 30, such as via a short range wireless communication protocol (e.g., Bluetooth). In some embodiments, the smart base 20 may, additionally or alternatively, be configured to communicate with the external computing device(s) 30 through a wireless network 40. The base 20 may be configured to communicate with the external computing device (s) 30 via any suitable communication protocols, such as, but not limited to, Bluetooth, Bluetooth Low Energy (BLE), ZigBee, Wireless USB, Wi-Fi, or others. A smart base 20 according to the present disclosure may be configured communicate with the one or more external devices via any suitable number of communication links (e.g., a first communication link 22, a second communication link 24, etc.). Also, the smart base 20 may be configured to establish multiple communication links to different devices (e.g., pairing with two or more of the user's personal devices, such as their smart phone and their smart TV). Moreover, the external computing devices 30 may include computing device with distributed computing functions (e.g., having/accessing storage and/or services residing remotely, such as in the cloud).

Figure 2:
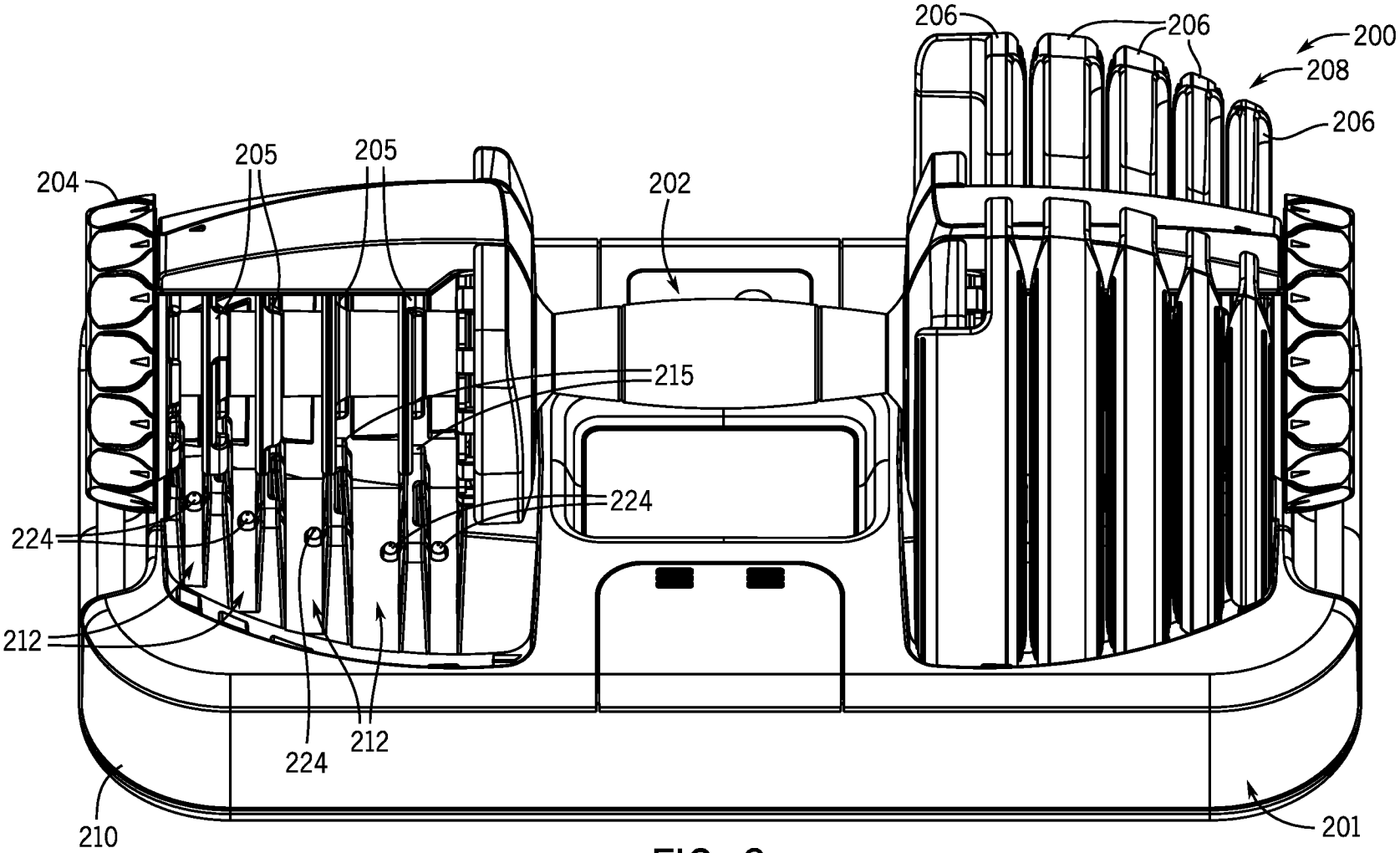
FIG. 2 shows an isometric view of an adjustable dumbbell base, such as the base of FIG. 1, shown together with the handle assembly of the adjustable dumbbell.
Figure 3:
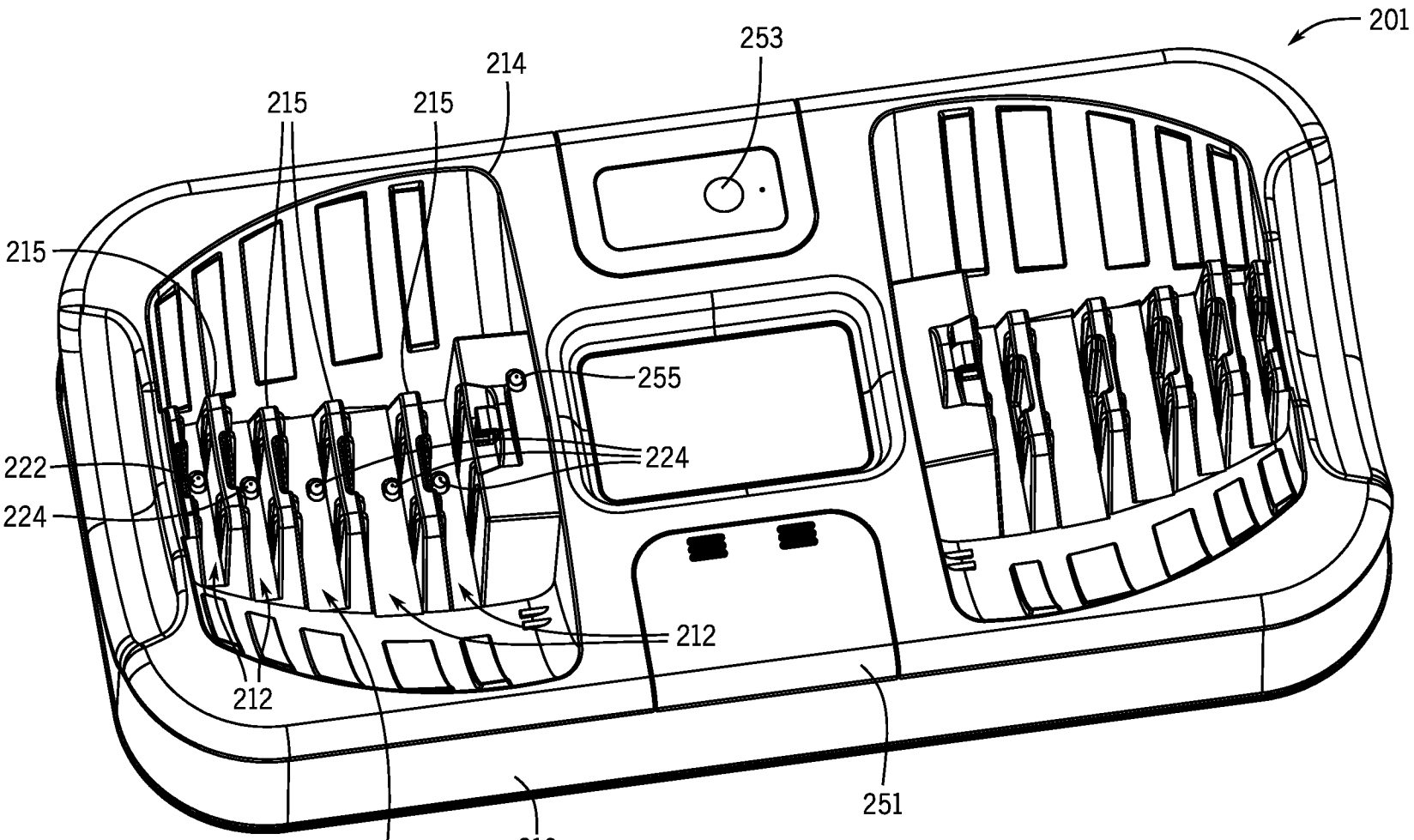
FIG. 3 shows an isometric view of the plate-sensing base of FIG. 2.
Figure 4:
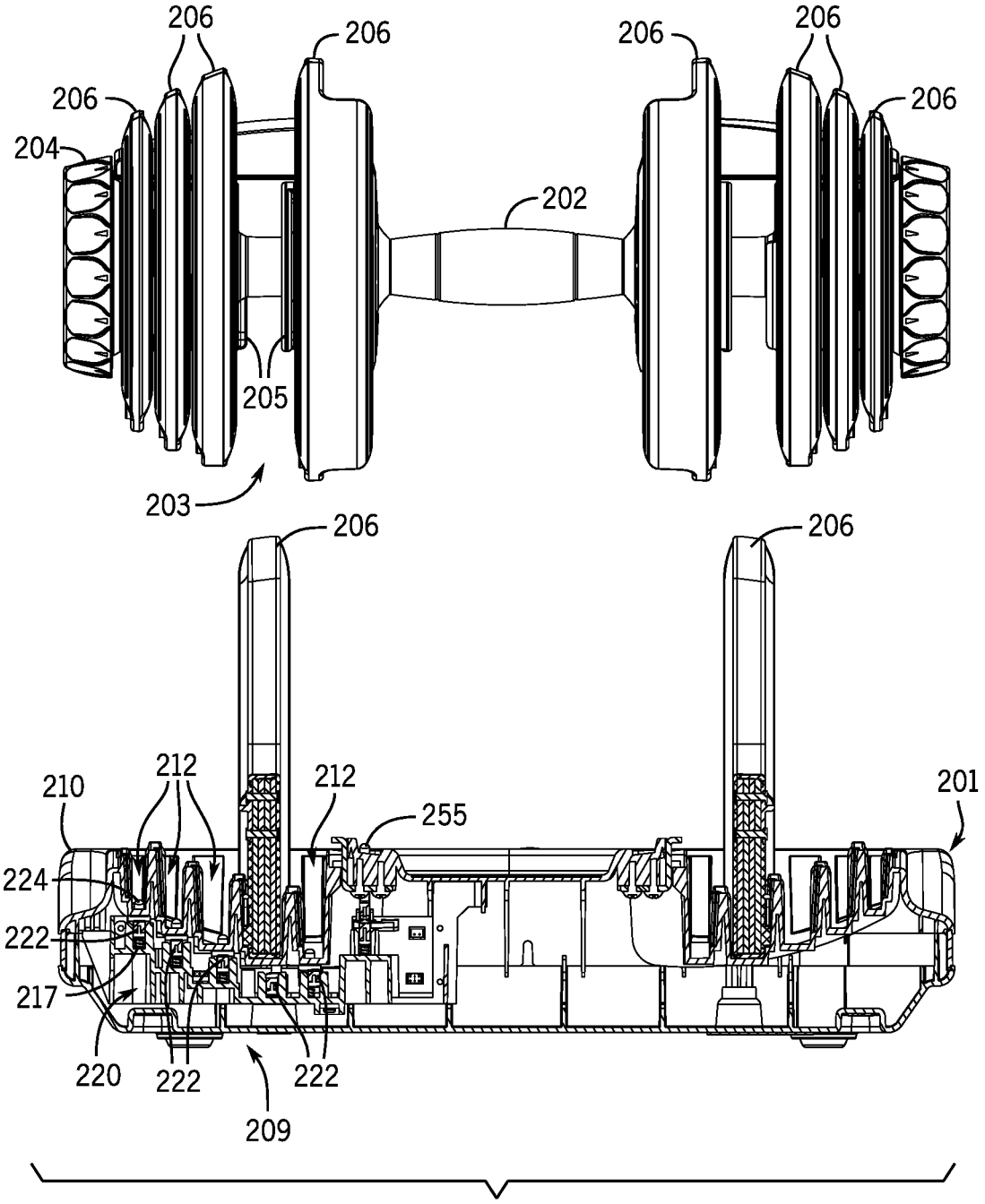
FIG. 4 shows a cross-sectional view of the base of FIG. 2 showing the dumbbell removed from the base with some of the weights attached to the dumbbell and others remaining in the base.

FIGS. 2-4 show components of an exercise system 200, including a plate-sensing base 201 according to some embodiments of the present disclosure. The plate sensing base 201 of FIGS. 2-4 may be used to implement the base 20 of the system 100 in FIG. 1. In FIGS. 2 and 4, the base 201 is shown together with the handle assembly (or simply handle) 202 of an adjustable free weight, which in the present example is an adjustable dumbbell 208. In other embodiments, the free weight may be an adjustable barbell. The base 201 is shown alone, without the free weight, in FIG. 3 for illustrating the various features thereof. Referring to FIGS. 2 and 4, the dumbbell 208 includes a selection mechanism 204 for selectively coupling a desired amount of weight to the handle 202 by way of selectively coupling different combinations of the plurality of weight plates (or simply weights) 206 to the handle 202. The dumbbell 208 of the present example is configured to operate with ten weight plates 206, which are grouped in two sets of five on opposite sides of the handle 202. In other examples, the adjustable free weight (e.g., dumbbell or barbell) may be configured for selectively coupling a different number of weights to the handle (e.g., a number fewer or greater than 10). In the present example, the individual weights 206 are coupled to the handle 202 between separator discs 205 spaced axially along the length of the dumbbell 208, on opposite sides of the handle 202. In other embodiments, the weights, separator discs and/or other features of the adjustable free weight (e.g., the type or placement of the selection mechanism 204) may be different.

Referring now also to FIG. 3, the base 201 includes a cradle 210 that supports the weight plates 206 and handle 202 when not in use. Any of the weight plates 206 that are unused (i.e. non-attached) to the handle remain in, and are supported by, the cradle 210 when the handle 202 is removed from the base 201. The cradle 210 includes positioning walls 215 that divide each of the two recesses 214 into a number of plate wells 212 corresponding to the number of weight plates 206 of the free weight. Each of the plate wells 212 is configured to accommodate an individual one of the plurality of weight plates 206. The plate wells 212 are configured to support the unused weight plates in a generally upright (or vertical) position to enable easy and fast alignment of the weights 206 into their respective plate slots 203 of the handle 202 when the handle 202 is returned to the base (e.g., after an exercise). The cradle 210 may also serve as an enclosure or housing of the base 201 substantially enclosing or concealing various internal components of the base (e.g., mechanical and sensor components of the plate-sensing assembly and other electronics of the base).

The base 201 is configured to detect the presence or absence of the individual weight plates 206 in the cradle for determining the weights remaining in the base and thus the weight attached to the handle. Referring for example to FIG. 4, the base 201 includes a plate-sensing assembly 220 attached to the cradle 210. In some embodiments, the plate-sensing assembly 220 is implemented using a combination of mechanical components (e.g., rigid members such as pivoting levers) and electronic sensors arranged to individually sense the presence or absence of a weight 206 in a given plate well 212. For example, the plate sensing assembly 220 may include a plurality of rigid members 222, each associated with a respective one of the plate wells 212. Each of the rigid members 222 is movably coupled to the cradle 210 such that it can move between a first (elevated or released) position and a second (lowered or depressed) position. Each rigid member 222 may be biased toward the first position (e.g., by a spring 217) and may include a plunger portion (or simply plunger) 224 which protrudes into the respective plate well 212 when the rigid member 222 is in the first position. The plunger 224 protrudes through an opening in the cradle 210 into the plate well 212. The plunger 224 is positioned in the plate well (e.g., along a bottom surface of the plate well) so as to contact and be depressed by the respective weight plate 206 when the weight plate 206 is placed in the plate well 212. As such, when a weight plate 206 is placed in its corresponding plate well 212, the weight 206 acts against the biasing force of the spring 217 moving the rigid member 222, via its plunger 224, to its second (lowered or depressed) position and when the weight plate 206 is removed from its corresponding plate well 212, the downward force on the spring is released, and the rigid member 222 and its plunger 224 move to their first position under the biasing force of the spring 217. In some embodiments, the plunger 224 is at or below the bottom surface of the plate well 212, thus not substantially protrude into the plate well 212, when the plunger 224 and rigid member 222 are in the second position. In other embodiments, the plunger 224 may be above the base surface of the plate well 212 when in the second position. Irrespective of the particular configuration of the plate-sensing assembly, when a given rigid member 222 is in the first position, a larger amount of the its plunger 224 protrudes into the plate well 212 than when the rigid member is in the second position. Movement of the rigid member from the first to the second position displaces the plunger downward towards the foot 209 of the base. Any suitable biasing element, such as a spring 217, may be used to bias the individual rigid members 222 toward the second position in the absence of a weight in the plate well.

In some embodiments, a single plate-sensing assembly 220 is provided to sense the presence or absence of weights in one of the recesses 214, which information is used to extrapolate the presence or absence of weights in the other recess, e.g., by assuming that weight plates 206 are symmetrically coupled to the handle 202. Having a single sensor assembly can reduce the complexity of the system and computational resources required to monitor the states of the sensors of the plate-sensing assembly. In other embodiments, an individual sensor assembly may be provided below each of the recesses 214 for independently sensing the presence or absence of weights 206 coupled to each side of the handle 202.

Figure 5A:
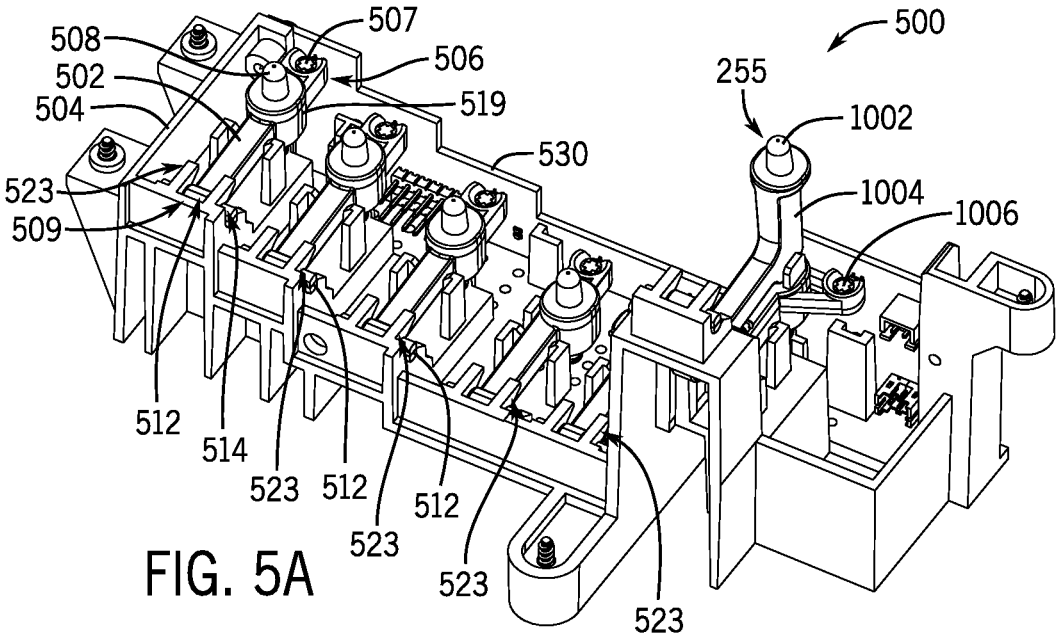
FIGS. 5A and 5B show an isometric view and a top view, respectively, of a sensing assembly or mechanism for a base according to the present disclosure, such as the base of FIGS. 2-4.
Figure 5B:
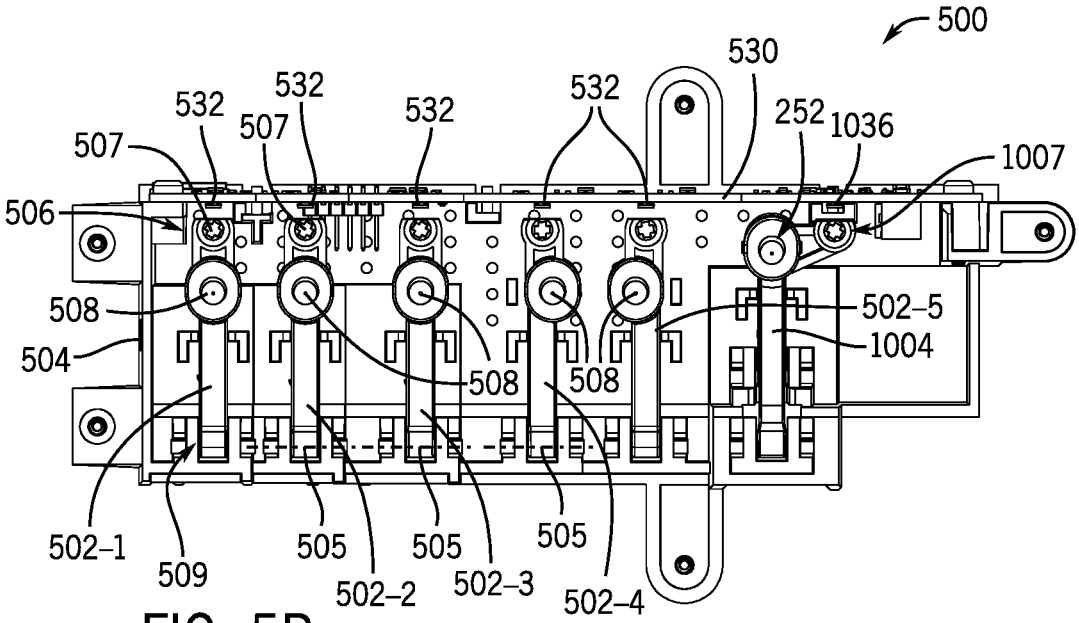
Figure 7A:
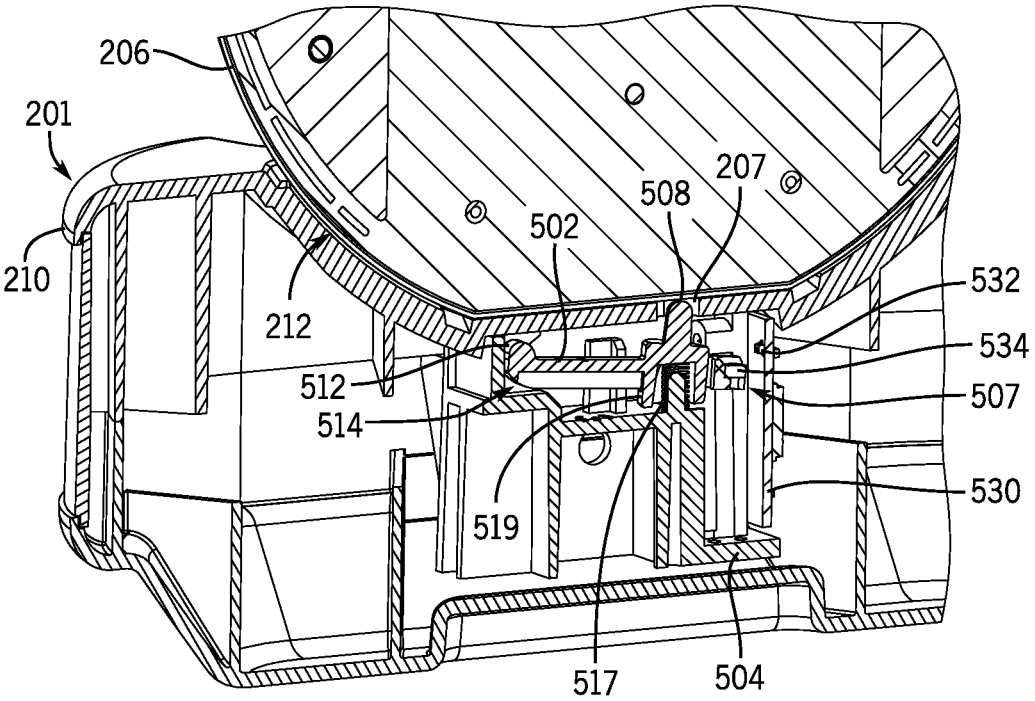
FIGS. 7A and 7B show section views of the base illustrating the operation of the sensing mechanism of FIGS. 5A and 5B.
Figure 7B:
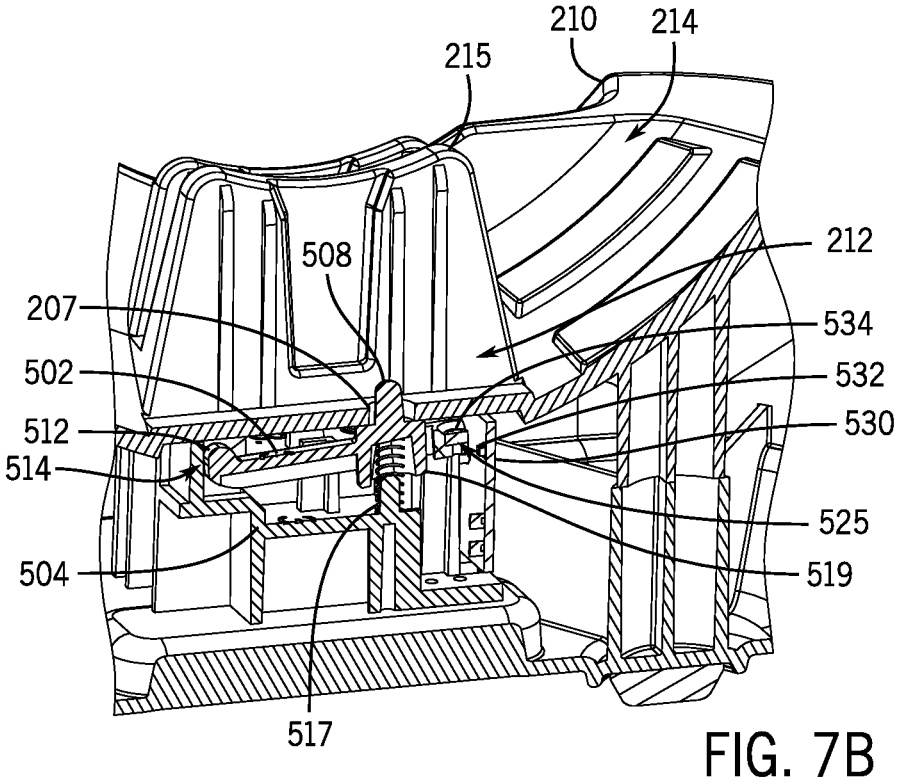

In some embodiments, the rigid members 222 are implemented by a set of pivoting levers. FIGS. 5A and 5B show an isometric view and a top view, respectively, of a plate-sensing assembly 500 according to the present disclosure, and FIGS. 7A and 7B shows partial section view of the plate-sensing assembly 500, illustrating its operation. The plate-sensing assembly 500 may be used to implement the plate-sensing assembly 220 of the base 201 in FIG. 2.

The plate-sensing assembly 500 includes a plurality of levers 502 which pivot between a first position (e.g., as shown in FIG. 7B), which is also referred to as elevated, raised or released position, and a second position (e.g., as shown in FIG. 7A) and which is also referred to as lowed or depressed position. Each lever 502 has a first end 509 pivotally coupled to the support structure 504 and an opposite, second end 506 that pivots about the levers pivot axis 505. The second end 506 may thus also be referred to as the free end or pivoting end 506 of the lever 502. The support structure 504 may be configured to pivotally support and couple each of the levers 502 to the underside of the cradle 210 such that the levers 502 are operatively positioned below the recess 214 with the plunger 508 of each lever 502 extending through an opening 207 (see FIGS. 7A and 7B) in the cradle 201 and into the respective plate well 212. To that end, the support structure 504 may include a corresponding plurality of pivot mounts 523, each configured to pivotally receive the first end 506 of the respective lever 502.

Figure 6:
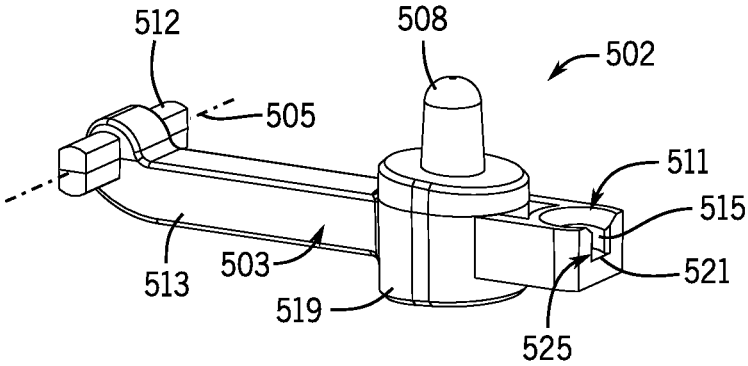
FIG. 6 shows one of the plurality of levers of the sensing mechanism in FIGS. 5A and 5B.

Each lever 502 may be pivotally coupled to the support structure 504, and thus to the cradle 210, via any suitable pivot joint (e.g., a pin joint). For example, and referring also to FIG. 6, each lever 502 may include a pin or axle 512, oriented transversely to the elongate portion 513, and thus to the length-wise dimension, of the lever 502. The axle 512 of each lever 502 is pivotally received in a passage or eye 514 defined by the support structure 504 (e.g., by the corresponding pivot mount 523). During use, each lever 502 is pivotable about its respective pivot axis 505 to move between the first and second positions. In some embodiments, each of the levers 502 may have a unique form factor (i.e. shape and size) for accommodating operative placement of the pivoting levers 502 underneath a contoured surface of the recess 214. In some embodiments, a subset of the levers (e.g., levers 502-1, 502-2, and 502-3) may have substantially the same form factor, reducing the part-count of unique components of the plate-sensing assembly 200. In some such embodiments, the support structure 504 (e.g., the location of the mounts 523) may be configured to substantially align some or all of the levers 502 horizontally (i.e. so their axes 505 lie in substantially the same vertical plane extending out of the page of FIG. 5B), vertically (i.e. so their axes 505 lie in substantially the same horizontal plane parallel to the page of FIG. 5B), or both, which may facilitate operative placement of the levers relative to a contoured recess 214 while maintaining a compact form factor.

Each of the levers 502 further includes a portion configured to protrude through the cradle, which is also referred to as protruding portion, plunger portion or simply plunger 508. The plunger 508 may be positioned near the lever's free (pivoting) end 506. When operatively assembled, the plunger 508 of each lever 502 may extend into a respective plate well 212 (see e.g., FIGS. 2 and 3A, and FIG. 7B) when the lever 502 is in the first (raised) position. In the present example, the plungers 508 extend generally perpendicularly to the elongate portion 513 of the respective lever 502 generally perpendicularly to the lengthwise dimension of the respective lever 502. A biasing element, such as a coil spring or any other suitable type of compression spring 517, biases each of the levers 502 toward the first position (e.g., as shown in FIG. 7B). The compression spring 517 may be substantially aligned with, such that it is positioned substantially directly below, each plunger 508 in some embodiments. In some such embodiments, the spring 517 may be received in a spring housing 519 below the plunger 508. The spring housing 519 may operatively couple the spring 517 to its respective lever. In other embodiments, the levers 502 may be differently biased, such as with a torsion spring operatively associated with each of the axles 512. In use, each lever 502 is physically actuated, through contact with the respective weight 206 (e.g., via its plunger 508) between the first (relatively higher) and second (relatively lower) positions. Each lever 502 further interacts, through its movement between the first and second positions, with a corresponding sensor 532 to communicate (e.g., to a processor) the position of the lever 502 and thus the presence or absence of a weight 206 in a given plate well 212. Each of the levers 502 includes a sensor engagement portion 507. In some embodiments, the sensor engagement portion 507 of each lever 502 is located at or near the lever's free (pivoting) end 506.

In the present example, the plate-sensing assembly 500 uses hall effect sensors to detect the position of each lever 502, and thus the presence or absence of a weight in the base. In other examples, different types of sensors may be used, as will be described further below. In the example in FIGS. 5A-7B, the sensor engagement portion 507 of each lever 502 is implemented by a magnet 534 which is carried, in a magnet seat 511, at the free end 506 of the respective lever 502. Each of the magnets 534 is thus fixed to, and moves with, the free end 506 of the respective lever 502 as the lever 502 pivots between the first and second position (e.g., as shown in FIGS. 7B and 7A respectively). The magnet seat 511 may be implemented by a recess 525 located at the free end 506 of the lever 502. The recess 525 is configured to accommodate a respective magnet 534 at least partially therein. For example, the recess 525 may have a shape corresponding to the shape of the magnet. In some examples, a substantially circular recess may be provided for a circular magnet. Any other suitable shape of the recess and magnet may be used. In some embodiments, the magnet 534 may be keyed to the seat 511 such that it only fits in the seat in one or limited number of orientations. Each of the magnets 534 may be press-fit, and additionally optionally glued to their respective seat 511. Each of the recesses 525 may have a top opening to accommodate passage of the magnet 534 and thus facilitate insertion of the magnet 534 into the seat 511. In some embodiments, the sidewalls 515 that define the recess may be interrupted, providing a side opening 521, which may expose a side of the magnet 534 oriented along (or facing) the length-wise direction of the lever 502, to facilitate a more effective engagement with the hall effect sensor. The sidewalls 515 may encircle the magnet 534 only partially but sufficiently so as to capture the magnet therein, preventing removal of the magnet along the length-wise direction. In some embodiments, the axle 512, the plunger 508, and the magnet seat 511 of a lever 502 are integrally formed with the elongate portion 513 whereby the respective lever 502 is implemented as an integral/unitary body 503.

A variety of different types of sensors may be used to implement the sensors 532. In the example in FIGS. 5A-7B, each of the sensors 532 is implemented by a hall effect sensor. Thus, the plate-sensing assembly 500 includes a plurality of hall effect sensors 532, each positioned to interact with a corresponding lever 502, e.g., via the respective magnet 534 which is fixed to, and thus moves with, the respective lever 502. The movement of the magnet 534 rails (or shifts) the corresponding hall effect sensor 532 between its low and high states. In some embodiments, the hall effect sensors 532 are positioned such that each sensor 532 generates a high voltage when the lever 502 is in the first (or elevated/released) position and a low voltage when the lever 502 is in the second (or lowered/depressed) position. In other embodiments, a reverse alignment may be used such that the sensor(s) 532 are instead railed (or shifted) to a high voltage state when the lever 502 is in the lowered position. Each of the sensors 532 is connected to a circuit (e.g., on a printed circuit board (PCB) 530) which generates one or more signals indicative of the states (e.g., high or low voltage) of each sensor 532, also referred to as sensor state signal(s). The sensor state signal(s) are communicated to a processor that determines the combination of weight plates 206 remaining in the base upon removal of the handle 202, and consequently the weights 206 attached to, and thus the total weight of, the free weight 208. The processor may be mounted to the PCB 530, directly thereto, such as on the side opposite the sensors, or indirectly via any suitable combination of electric conductors (e.g., a flex PCB or ribbon cable).

Figure 8A:
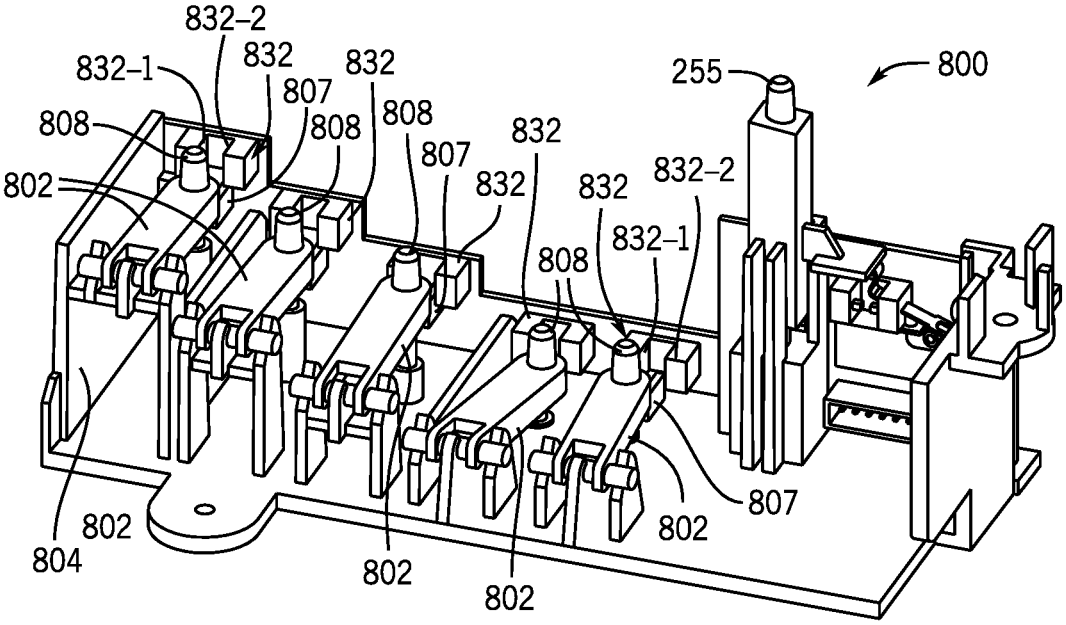
FIG. 8A shows an isometric view of another example of a sensing mechanism for a base according to the present disclosure, such as the base in FIG. 2.
Figure 8B:
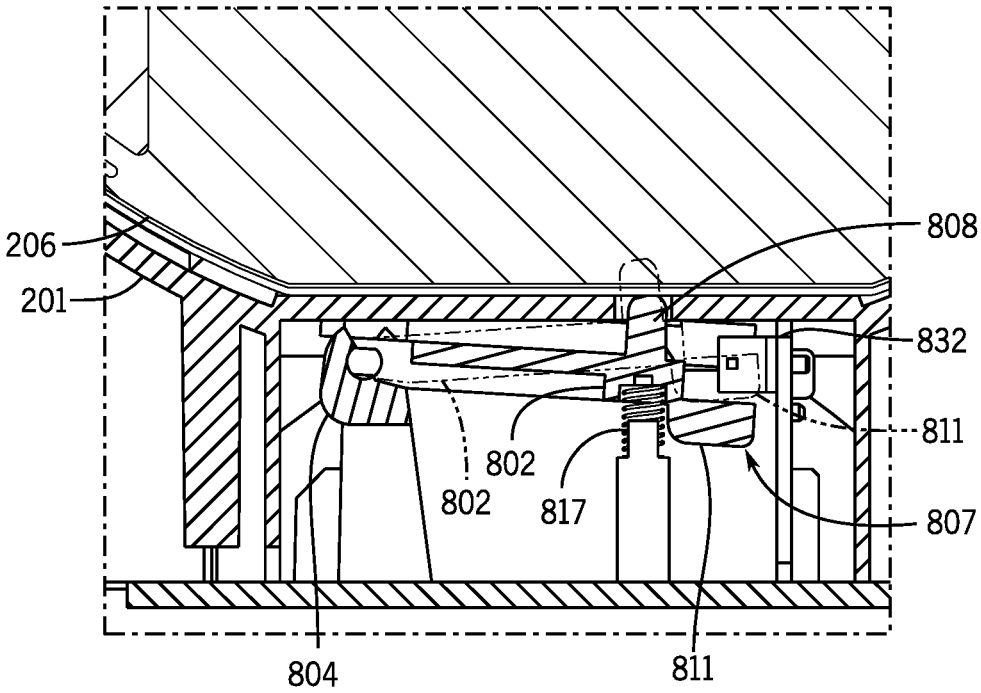
FIG. 8B show a section view of a base, such as the base of FIG. 2, illustrating the operation of the sensing mechanism of FIG. 8A.

FIGS. 8A and 8B show a plate-sensing assembly 800 according to further examples of the present disclosure. The plate sensing assembly 800 may be used to implement the plate sensing assembly 200 of the base 201 of FIG. 2. The plate-sensing assembly 800 may include a number of components similar to those of the plate-sensing assembly 500 but instead of using hall effect sensors, the mechanical components interact with optical sensors. For example, similar to the plate sensing assembly 500, the plate-sensing assembly 800 includes a plurality of pivoting levers 802, each of which is pivotally coupled to a support structure 804. Similarly, each lever 804 includes an elongate body 813, an axle 812, a plunger 808 and a sensor engagement portion 807. Each of the levers 802 is pivotally coupled at its one end to the support structure 804, and is biased (e.g., by a respective spring 817) toward a raised position in which the plunger 808 protrudes through the base (e.g., as shown in phantom line in FIG. 8B).

The individual sensors 832 in this example are optical sensors. For example, each sensor may be an optical interrupt sensor which includes first and second sensor portions 832-1 and 832-2, respectively, spaced apparat from, and arranged to face, one another. The first sensor portion 832-1 may be the optical transmitter 832-1 (e.g., a light source such as an LED) and the second sensor portion 832-2 may be the optical receiver (e.g., a light detector), or vice versa. The sensor engagement portion 807 is implemented by a flag 811, which is operatively positioned on the lever to move between a first position when the plunger is in the first, elevated position (as shown in phantom line in FIG. 8B) and a second position when the plunger is in the second, lowered position (shown in solid line in FIG. 8B). In some embodiments, the optical interrupt sensor is position such that the flag 811 blocks or interrupts the light of sight between the optical transmitter and receiver when the lever 802 is in the raised position. In other embodiments, the optical sensor is positioned such that the interrupted state (e.g., a low or null value) of the sensor 832 is instead associated with the lowered position of the lever. Similar to the prior example, each of the plurality of sensors 832 may be connected to a circuit (e.g., provided on a PCB 830) for communicating the sensor signals to a processor.

In other embodiments, a different type of optical sensors may be used in place of photo-interrupters of the plate-sensing assembly 800. For example, each sensor 832 may be a photo sensor having the transmitter and receiver located on the same side of the flag 811 as opposed to opposite sides thereof. In such embodiments, the transmitter is arranged to transmit light towards the flag, when the flag is in the light of sight of the transmitter, and the receiver is arranged to detect light reflected (e.g., by the flag). When the lever is in a position in which the flag does not substantially block the light of sight of the light transmitter, smaller amount or no reflected light is detected by the receiver, resulting in a different signal (e.g., a low voltage state) of the sensor. Also, it should be noted that while the mechanical components (e.g., levers 502 of the assembly 500 and levers 802 of the assembly 800) are shown as pivotally coupled to the base 201 in the illustrated examples, in other embodiments, the mechanical components (e.g., rigid members) that move between the first and second positions to interact with the sensors may be differently movably coupled to the base. For example, each of the rigid members, which may be implemented by a lever or other suitable rigid structure, may instead be supported in a track defined by the support structure, and may be configured to translate up and down, rather than pivot, to raise and lower the plunger portion of the lever.

Figure 9A:
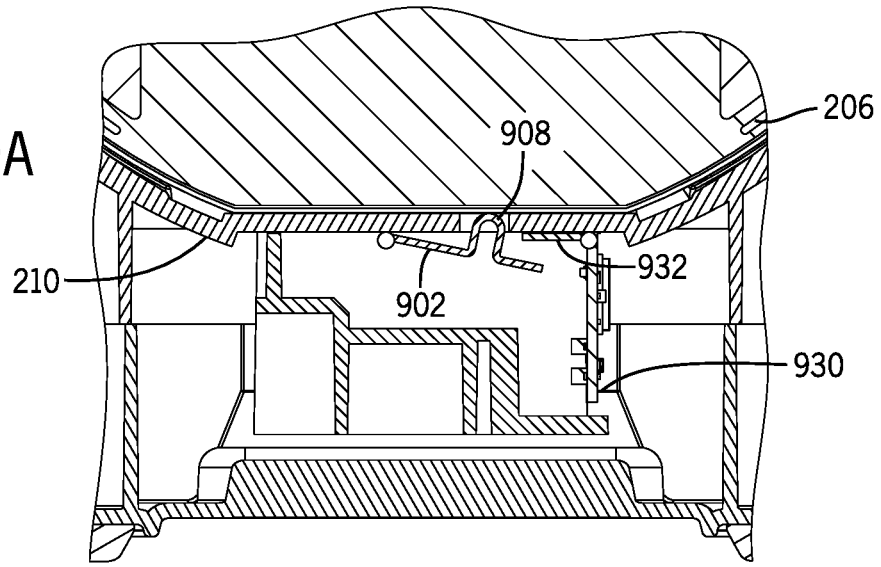
FIGS. 9A and 9B show cross-sectional illustrations of yet another example of a sensing mechanism for a base according to the present disclosure, such as the base in FIG. 2.
Figure 9B:
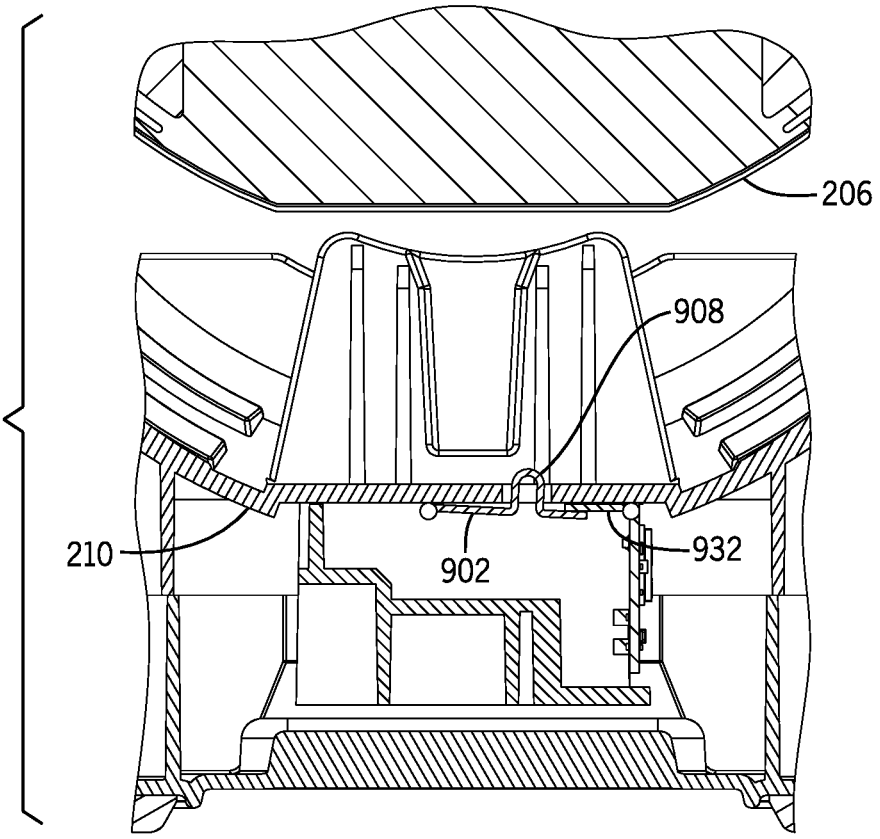

The plate sensing assembly may be implemented using various other combinations of mechanical and electrical components interacting to detect the presence or absence of the individual weights in the base. For example, as shown in FIGS. 9A and 9B, each of the mechanical components may be implemented by a rigid member 902, which has a portion 902 protruding into the plate well. The rigid member 902 is pivotally coupled to the cradle 210 and is made from an electrically conductive material to act as a switch. The switch is biased toward the closed position (as shown in FIG. 9B), in which the switch closes the sensing circuit 932. When the switch is depressed (i.e. when a weight plate 206 is present) the switch rotates out of position and breaks electrical contact, thereby interrupting the circuit 932. When the weight plate 206 is removed (as shown in FIG. 9B), the switch springs back into position (i.e., with plunger portion 902 extending into the plate well) with its free end making electrical contact and closing the sensing circuit 932 associated with that particular plate well. A similar sensing circuit is provided for each plate well associated with at least one of the two recesses of the base, such that the presence or absence of the weights can be individually detected. The states of the sensing circuits 932 are communicated (e.g., via PCB 930, to a processor such that the weights remaining on the base, and consequently the weights attached to the handle can be detected upon removal of the handle from the base. In some embodiments, the sensing circuit may alternatively or additionally includes sensors in-line with resistors, such that each combination of docked plates provides a unique summation of total resistance to indicate user's selected weight. Various other types of switches may be used in a similar fashion in other embodiments (e.g., in a linear, pivot action or other).

Figure 10A:
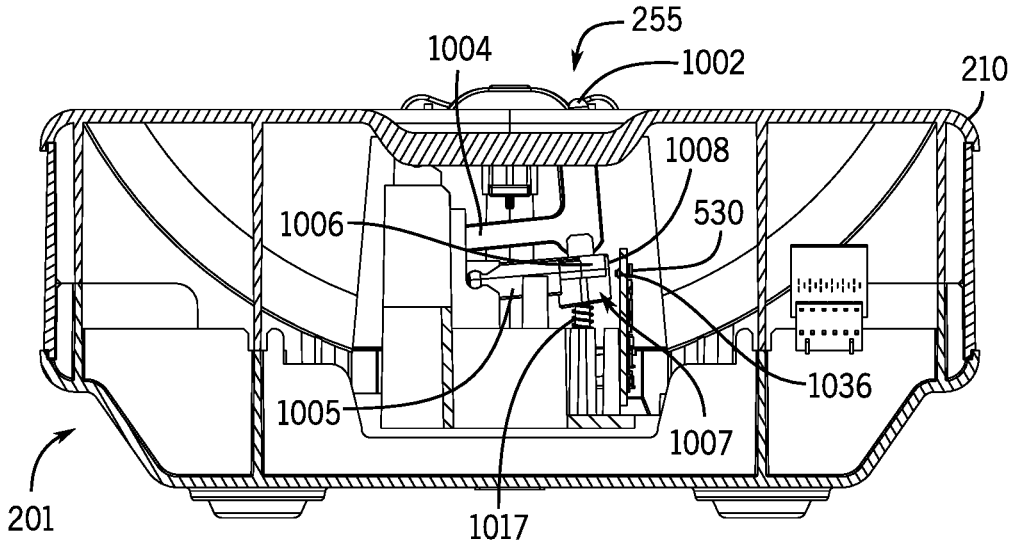
FIG. 10A shows a cross-section view of the base showing a plate sensing activation mechanism according to one embodiment.

In some embodiments, electronics of the base (e.g., the sensors and/or communication interface) may be powered by an on-board power source (e.g., one or more batteries, which may be rechargeable). In some embodiments, the one or more batteries may be replaceable by the end user, and an battery access panel 251 may be provided in a convenient location of the cradle such as on a side of the cradle accessible to the user even when the free weight is docked on the base. To conserve power, the base may be configured to operate in different modes, including at least one awake or active mode in which power is provided to the plate-sensing assembly, and a sleep or low power mode, during which the sensor assembly may not be powered. The base may be toggled between these modes in a variety of ways. For example, the base may include a switch for toggling the base from the sleep mode to an awake or active mode. The switch may be connected to a button 253 (see FIG. 3), which may be part of the base's user interface (U/I) configured to enable the user to activate the base and receive feedback about the operational state of the base, e.g., battery status, connection status, etc. In some embodiments, the base is additionally or alternatively configured to automatically switch to active mode by removal of the handle from the base. In such embodiments, the switch may be additionally or alternatively connected to an activation member 255 which is engaged (e.g., depressed or released) by the handle when the handle is positioned in or removed from the base. Referring back to FIGS. 5A, 5B and also to FIG. 10, the activation member 255 may be implemented by a plunger 1002 extending from a pivoting lever 1004. The lever 1004 is pivotally coupled to the support structure 504 and thus to the cradle 210 of the base 201. The activation member 255 (e.g., lever 1004 and plunger 1002) are biased upward towards the handle by a spring 1017. Placement of the handle on the base acts against the spring force, depressing the member 255 downward. In some embodiments, the spring 1017 acts indirectly on the lever 1004, for example through a second pivoting lever 1005 positioned between the spring 1017 and the lever 1004. The position of the plunger 1002 is detected by a sensor, for example a hall effect sensor 1036, an optical sensor or any other suitable sensor. For example, activation member 255 may include a sensor engagement portion 1007 similar to that of the lever 502. Depending on the type of sensor used, there may be provided a magnet 1006 fixed to a seat 1008 which extends from one of the levers 1004 or 1005 (if present) in an operative direction towards the hall effect sensor 1036. The sensor 1036 may be connected to the same PCB 530 supporting the other sensors 532 of the plate sensing assembly. Similar to the operation of the pivoting levers 502, the movement of the magnet 1006 caused by the movement of the activation member 255 up and down rails (or shifts) the hall effect sensor 1036 between its high and low states to trigger the activation of the base (e.g., waking up the base when the handle is removed) and, responsively, the delivery of power to the plate sensing components of the base.

Figure 10B:
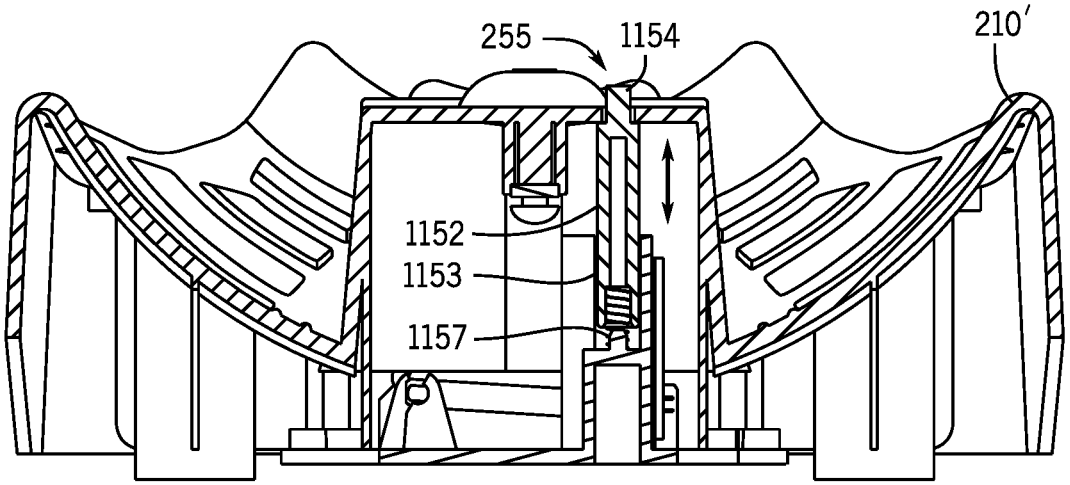
FIG. 10B shows a cross-section view of the base showing a plate sensing activation mechanism according to another embodiment.

In the example in FIG. 10B, which shows a section view of a similar cradle 210', the activation member 255 may be implemented by a rigid post 1152, which is received in a pocket 1153 defined by its supporting structure (e.g., support structure 504 or 804). The post 1152 is configured to move substantially vertically between its raised and lowered positions, as constrained by the pocket 1153. The post 1152 includes a protruding portion or plunger 1154 that penetrates the cradle and is exposed on the user-facing side thereof. The post 1154 is biased towards the raised position (e.g., as shown in FIG. 10B) by a spring 1157. Upon placement of the handle in the cradle 201', the plunger 1154 is depressed by the handle lowering the post 1152, which may interact with a sensing component to communicate the position of the post to the switch, or may directly couple the position of the post to the wake-up switch of the base. The post configuration of the activation member may be used in a base according to any of the examples herein (e.g., in base 201 of FIG. 2). The activation member may be implemented differently in other embodiments herein.

Figure 11:
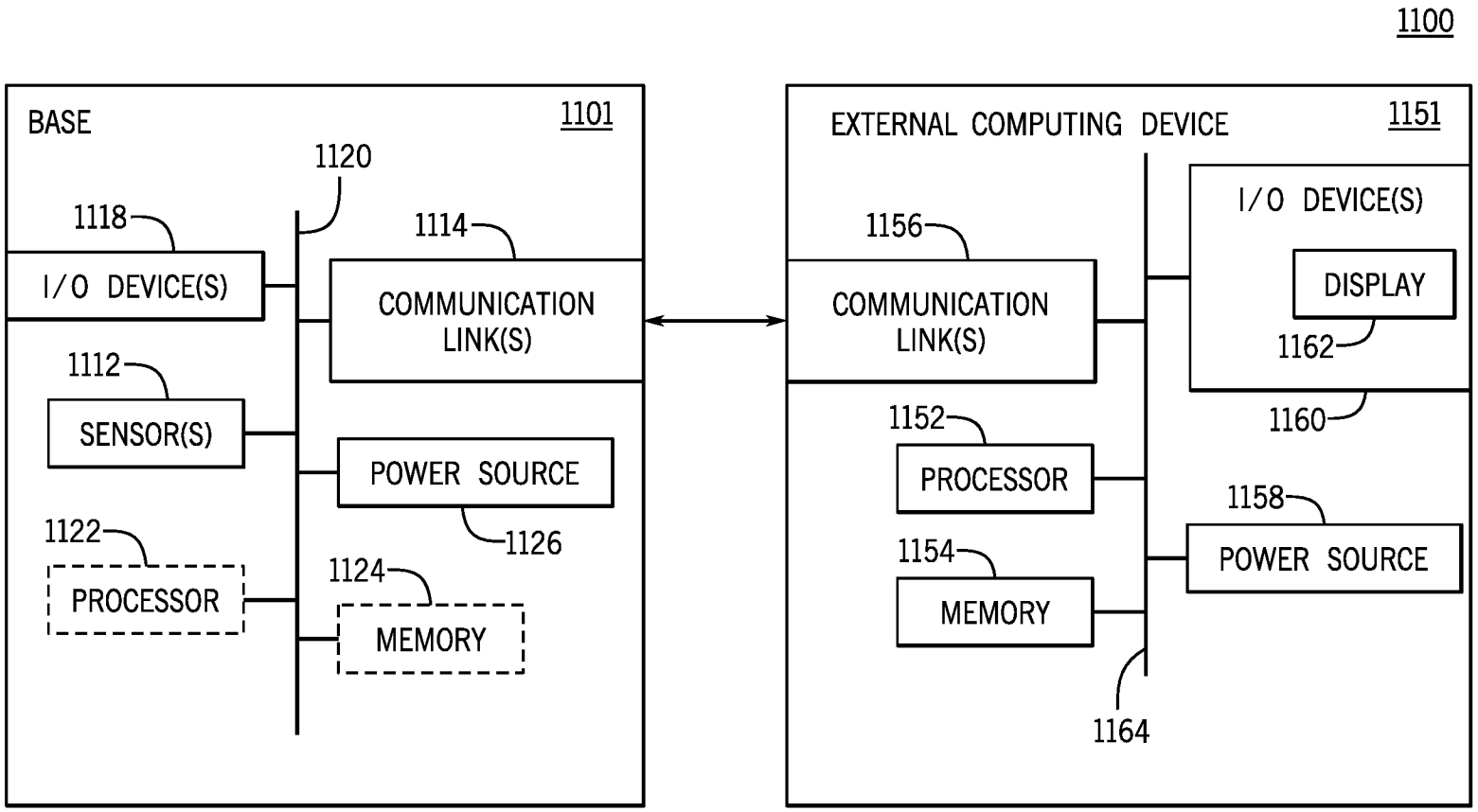
FIG. 11 shows a block diagram illustrating electronic components of a base according to the present disclosure.

FIG. 11 shows a simplified block diagram of electronic components of a smart base 1801 and an external computing device 1802 according to the present disclosure. The electronic components of the base 1801 may be included in a base according to any examples herein (e.g., base 201). Similarly, the electronic components of external computing device 1802 may be present in the external computing device 30 of FIG. 1. As shown in FIG. 11, the smart base 1801 according to the present disclosure includes at least a power source 1126, one or more sensors 1112, one or more I/O devices 1118 and at least one communication link 1114. Optionally, the base 1101 may include a memory 1124 and at least one processor 1122, e.g., for processing the sensor signals and/or controlling the base's user interface. In some embodiments, sensor data is processed on board the base (i.e. by a processor located in the cradle). In other embodiments, the sensor data is at least partially processed by a processor not housed in the cradle. For example, the final determination of the weight selection of the user may be made by a processor located remotely from the base (e.g., processor 1152 of the external computing device 1151). The external computing device 1151 includes one or more I/O devices 1160, communication link(s) 1156, and at least one processor 1152, memory 1154 and a power source 1158.

The power source 1126 of the base 1101 and the power source 1258 of the computing device 1151 may be implemented by on-board power (e.g., a battery), which may be rechargeable in some embodiments. Any suitable battery technology may be used, e.g., Nickel-Cadmium (NiCd), Nickel-Metal Hydride (NiMH), lithium-ion (Li-ion), lithium-sulfur, graphene aluminum-ion, solid state, etc. Additionally or alternatively, the base 1101 and/or computing device 1151 may be configured to be powered by an external power source, via a wired connection or wireless connection, e.g., to the grid. The I/O device(s) 1118 of the base 1101 may include one or more input devices (e.g., the button 253, a keyboard, a touchpad, etc.) and one or more output device (e.g., one or more status indicators which may be implemented by one or more discrete LEDs, an LED display, and ELD display, or a display of any other suitable type). The I/O device(s) 1160 of the external computing device 1151 may include at least one display 1162 (e.g., for displaying information relating to the exercise system), which may be implemented by any suitable display technology such as Liquid crystal display (LCD), LED, Organic LED, Plasma display (PDP), Quantum dot (QLED) display, etc. The I/O device(s) 1160 may further include various other input and output devices such as a microphone, a speaker, a keyboard, a touchpad, and/or a touchscreen. The communication links 1114 and 1156 of the base 1101 and computing device 1151, respectively, may be implemented using any suitable wireless communication interface/technology, such as Bluetooth, Bluetooth Low-Energy (BLE), ZigBee, Near-Field Communication (NFC), Wi-Fi, a cellular communication technology, such as GSM, LTE, or others.

The processor 1122, which may be interchangeably referred to as controller, and the processor 1152 may be implemented by any suitable processor type including, but not limited to, a microprocessor, a microcontroller, a digital signal processor (DSP), a field programmable array (FPGA) where the FPGA has been programmed to form a processor, a graphical processing unit (GPU), an application specific circuit (ASIC) where the ASIC has been designed to form a processor, or a combination thereof. For example, the processors 1122 and/or 1152 may include one or more cores, which may include one or more arithmetic logic units (ALUs), floating point logic units (FPLUs), digital signal processing units (DSPUs), or any suitable combinations thereof. The processors 1122 and/or 1152 may further include one or more registers communicatively coupled to the core(s), which are implemented by any suitable combination of logic gates and/or memory technologies. The processors 1122 and/or 1152 may include one or more levels of cache memory coupled to the core(s) for providing data and/or computer-readable instructions to the core(s) for execution. The cache memory may be implemented by any suitable cache memory type, for example, metal-oxide semiconductor (MOS) memory such as static random access memory (SRAM), dynamic random access memory (DRAM), and/or any other suitable memory technology.

The on-board memory 1124 of the base and the memory 1154 of the external computing device 1151 may be implemented, in part, by the cache memory of respective processor and may thus include volatile memory. The memory 1124 and or memory 1154 may also include non-volatile memory, in some embodiments, which may be implemented using any suitable non-volatile memory technology such as Read Only Memory (ROM) (e.g., masked ROM, Electronically Programmable ROM (EPROM), or others), Random Access Memory (RAM) (e.g., static RAM, battery backed up static RAM, Dynamic RAM (DRAM), or others), Electrically Erasable Programmable Read Only Memory (EEPROM), Flash memory, or others.

The electronic components of the base and external computing device may be communicatively connected using any suitable circuit(s) 1120 and 1164, respectively (e.g., a data bus).

Figures 12, 13:
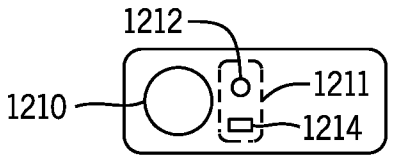
FIG. 12 shows an example user interface of a base according to the present disclosure.
FIG. 13 shows various states of the user interface of FIG. 12.

A base according to any of the examples herein (e.g., base 201) may include a button for activating the sensing function of the base. FIG. 12 shows an example of a user interface (U/I) 1200 that may be used to implement the user interface a base according to the present disclosure (e.g., base 201). The U/I may include at least one button 1210, and a status indicator 1211, which may be implemented by one or more lights (e.g., first status light 1212, second status light 1214, etc., either or both of which may be an LED light or any other suitable light) or by another suitable feedback device, such as an audible indicator (e.g., a speaker). In some embodiments, only a single status light is used to provide various status information such as battery level, connection status, etc. In other embodiments, a dedicated light may be included to provide different status information, for example the first status light 1212 may signal connection status, while the second status light 1214 may signal battery level. In some embodiments, the pressing of the button 1210 activates (or wakes up) the base 201 such as by causing power to be provided to the sensor assembly thereby activating the sensing function of the base 201. In some embodiments, the button 1210 may additionally, optionally, be used for establishing a wireless connection between the base 201 and a wireless network or directly with an external computing device 30 (e.g., via Bluetooth pairing). In other embodiments, two separate buttons may be provided, one for activating the base 201 and one for establishing a wireless connection to the base 201. In some embodiments, the base 201 may be configured to wake up automatically without the user pressing the button 1210, such as in response to the removal of the handle from the base 201. In other embodiments, the waking of the base 201 is performed via the user interface 1200 (e.g., by pressing button 1210) and the removal of the handle 202 causes the automatic transmission of one or more signals (e.g., sensor state signal(s)) to the external computing device 30, if the base 201 is communicatively connected to (e.g., paired with) an external device 30. In some embodiments, additional functions may be invoked by the button 1210, or additional buttons may be included to provide other functionality by the base 201.

At any given time, the base 201 may be in any one of a plurality of operational modes or states. The U/I 1200 may also exist in different states in which the U/I 1200 exhibits different behaviors, depending on the operational mode of the base 201. Table 1300 in FIG. 13 shows different U/I states and the different behaviors of the U/I 1200 associated therewith. For example, when the base 201 is in a first operational mode, interchangeably referred to as low-power, sleep or standby mode, the U/I may be in a first state 1302, in which the status indicator (e.g., status light 1212) is Off. In some cases, the same U/I state may be associated with two or more different modes of the base 201. For example, the U/I state 1302 may also be associated with the operational mode of the base 201 in which the base 201 conserves power while in active, connected mode, for example when the battery of the base 201 is low (e.g., if battery charge is at 25% or less, if battery power for only 8 hrs of active use remains, or some other predetermined battery level). This mode may also be referred to as power conservation mode, and the U/I 1200 may exists in the same state as when the base 201 is in the sleep mode, in which the status light is Off, even though the base may be in active use (e.g., sensing and/or transmitting signals). If the base 201 is awake but not connected, the base 201 may be referred to as existing in an "awake but not connected" mode. In this mode, the U/I 1200 may exist in a second state 1304, in which the status light is On (e.g., a continuous or solid light), and has a first color (e.g., white or other predetermined color). If the base 201 is in connecting mode (e.g., the base 201 is discoverable or in the process of pairing, such as when using Bluetooth connectivity), the U/I 1200 may exist in a third state 1306, in which the status light 1212 is intermittently On and Off (i.e. blinking) in the same color as the "awake but not connected" mode. In some embodiments, the color of the blinking status light in the third state 1306 may be different from the color of the continuous/solid light of the second state 1304.

Once a wireless connection has been established with the base 201 (e.g., the base 201 is paired to an external computing device 30), the U/I 1200 transitions to a fourth state 1308, in which the status light is On (continuously) but has a different color than when the base is not connected and/or pairing (e.g., Blue or other predetermined color different from the color of the second and/or third states 1302, 1304, respectively). Finally, if the power supply (e.g., battery) of the base 201 is low (e.g., below a threshold percentage of charge and/or below a predetermined amount of active use time), the status indicator may provide a warning of the low battery state such as by blinking a predetermined number of times (e.g., 3, 4, 5 times, in some cases more), in a distinct color (i.e. different from the colors used for other, active operational states), for example a red or orange color, and may then, optionally, turn off (or time out) to conserve power, at which point the U/I 1200 may transition into the state 1302. As previously mentioned, in some embodiments, the U/I 1200 may include separate indicators for status (e.g., first status light 1212) and battery level (e.g., second status light 1214). In some embodiments, the battery level indicator (e.g., second status light 1214) may be configured to communicate the level of battery power as it is depleted. In other embodiments, the battery level indicator (e.g., second status light 1214) may be configured to operate as low battery indicator which activates only when the battery level falls below a predetermined level (e.g., a power level providing 10 hours (or less) of active use). In some such embodiments, the battery level indicator (e.g., second status light 1214) may be tied to the operation of the status indicator (e.g., first status light 1212) in that the battery level indicator (e.g., second status light 1214) is only on when the status indicator (e.g., first status light 1212) is on. This ensures that the battery level indicator is only On and using power when the user is likely to be interacting with the base and can thus see the indicator, thereby preserving battery power. The battery level indicator (e.g., second status light 1214) may be configured to follow the same time-out process as the status indicator, e.g., as described further below with reference to FIG. 15. In some embodiments, the various status indications (e.g., low battery, connection status, etc.) associated with the base/adjustable dumbbell may be communicated to the user via the external computing device to which the base is connected, in addition to or instead of the indicator(s) 1211.

Figure 14:
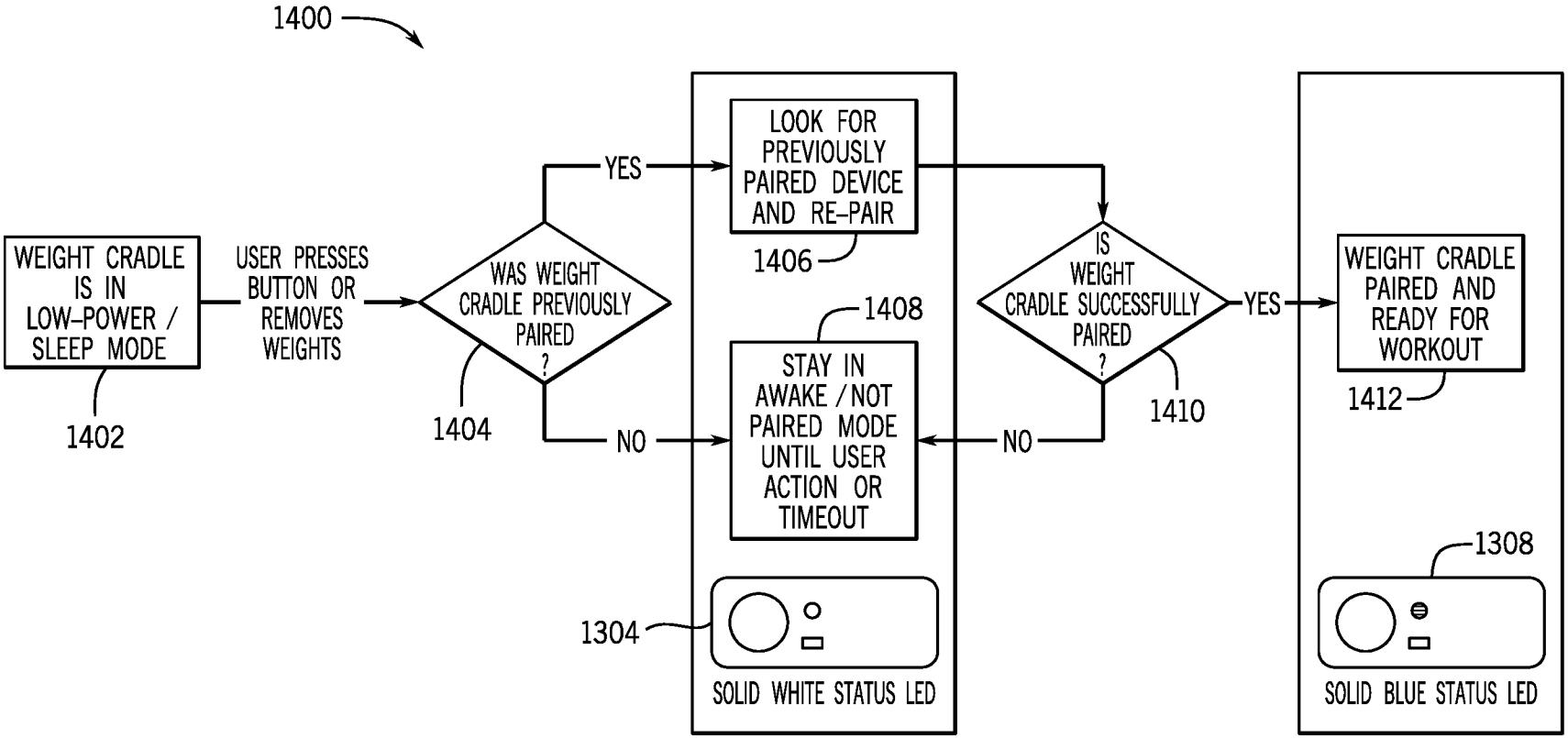
FIG. 14 shows a flow diagram of a first process associated with the user interface of FIG. 12.

The base 201 is configured to transition to an active (or awake) state, in which power is provided to the sensing components, when the button 1210 is manipulated in a predefined manner (e.g., pressed once). In some embodiments, the base 201 additionally or alternatively transitions to awake state automatically upon removal of the handle 202 from the base 201. FIG. 14 shows a flow diagram of a process 1400 via which the base 201, and consequently the U/I 1200, transition from the low power (or sleep) mode to active, connected mode. The base 201 is initially in the low-power mode, as shown in block 1402. The base 201 may exist in this state when the base 201 is not in active use (e.g., after the handle 202 has been on the base 201 for a set period of time). In the embodiment in FIG. 14, the pressing of the button 1210 causes the base 201 to wake up, and the processor of the base determines if a wireless connection has been previously established with the base. For example, when using a Bluetooth connection, the processor determines if the base has previously been paired with a device, as shown in block 1404. If the answer at block 1404 is yes, attempt to re-stablish the previously set up connection is made. Continuing with the Bluetooth example, the base attempts to locate the previously paired device, as shown in block 1406. If a device the base was previously paired with is present, the base automatically re-pairs with that device. While the base is attempting to re-establish connection, the U/I exists in the associated state (e.g., the third state 1306 of FIG. 13). When the wireless connection has been established (e.g., upon successfully re-pairing with the external device, as shown in block 1410), the base transition to an active, connected state, as shown in blocks 1412 and the U/I shifts to the associated state (e.g., the fourth state 1308 of FIG. 13). If the answer at block 1404 is No (e.g., the base has not been previously paired), the base transitions to an "awake but not connected" mode, as shown in block 1408, and its U/I shifts to the associated state (e.g., the second state 1304 of FIG. 13). In addition, and if the result of attempting to re-establish the previous connection (e.g., the device is not present or pairing is not successful for some other reason) is not successful at block 1410, the base may similarly transition to the "awake but not connected state" (block 1410) and the U/I would transition to the associated state (e.g., state 1304). As shown in block 1408, the base and U/I may remain in such states for a predetermined period of time (e.g., before the base times out and returns to asleep mode) or until user input is received (e.g., the pressing of button 1210).

Figure 15:
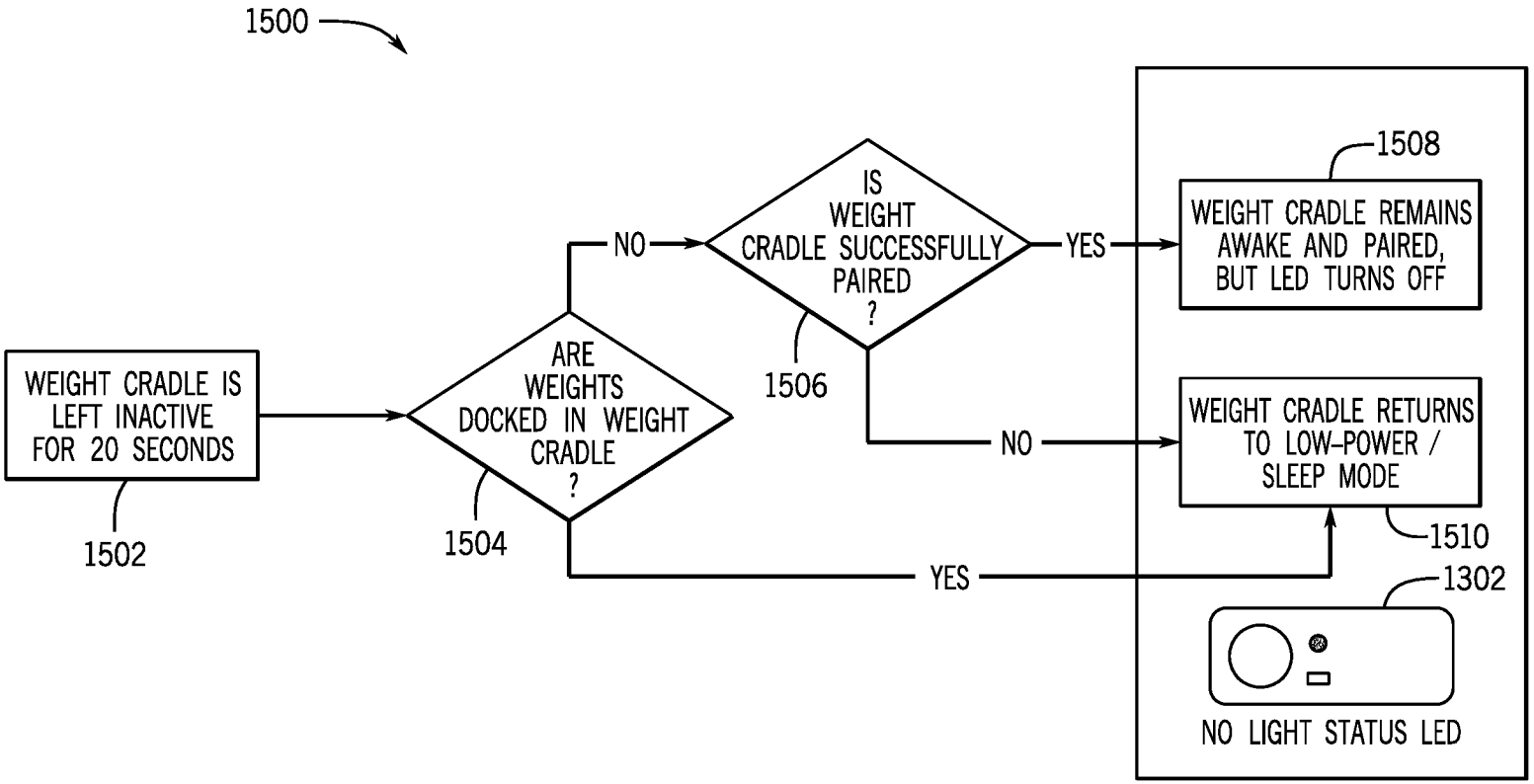
FIG. 15 shows a flow diagram of a second process associated with the user interface of FIG. 12.

The flow diagram of process 1500 in FIG. 15 illustrates the conditions under which the base 201 and its U/I 1200 transition back to low power (or sleep) mode. This process 1500 may thus also be referred to as a "time-out" or "return to sleep" process. As can be seen in block 1502, if the base remains inactive for a predetermined period of time, e.g., 15 seconds, 20 second, 25 seconds or more, or another suitable predetermined period of time, which period will also be referred to as the period of inactivity, the processor determines, as shown in block 1504, whether the weights are docked in the cradle. The processor determines if the weights are in the cradle using the plate-sensing assembly. The term inactivity, as used herein, implies that during this period no user inputs are provided to the user interface and detected by the processor, nor are any sensor state changes detected and communicated to the processor from the plate-sensing assembly. The inactivity period may be user-configurable, e.g., via the user interface or via an external computing device 30 with which the base 201 is communicatively coupled (e.g., the user's smart phone, which may execute an exercise tracking and interface application communicating with the dumbbell/base). In other embodiments, the inactivity period is preprogrammed and configurable only by the manufacturer. If the base 201 remains inactive for the predetermined inactivity period, and upon determination that the weights are docked in the base, the base transitions to the low power (or sleep) mode, as shown in block 1510. Consequently, the U/I transitions to the corresponding state, e.g., the first state 1302 of FIG. 13, in which the status indicator (e.g., status light 1212) is Off. If no weights are detected as docked or present in the base at block 1504, the processor determines, at block 1506, if a wireless connection has been established (e.g., the base is successfully paired to an external computing device 30). If the outcome of the determination at block 1506 is Yes, then the base 201 remains in active (also referred to as awake), connected mode as shown at block 1508. Otherwise, the base 201 transitions to the low power (or sleep) mode, as is shown at block 1510 with the U/I shifts to the corresponding state (e.g., state 1302).

Figure 16:
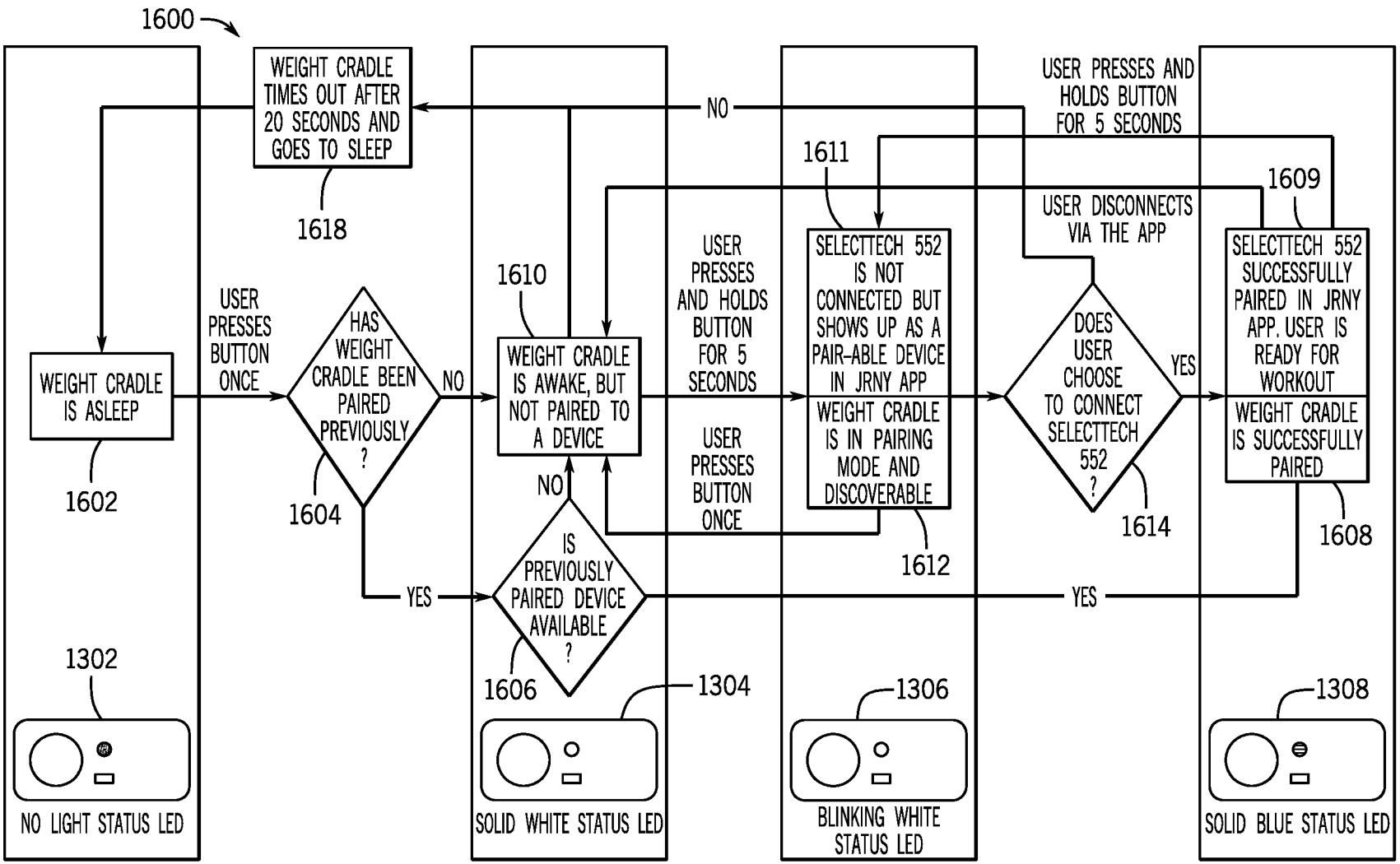
FIG. 16 shows a flow diagram of a third process associated with the user interface of FIG. 12.

FIG. 16 shows a flow diagram of a pairing process 1600 that may be implemented by a smart base according the present disclosure (e.g., base 201). The base may start off in the sleep mode (block 1602) and transition from the sleep mode to awake, e.g., responsive to the user pressing the button 1210. In embodiments in which the same button is used to invoke different functions, the number of button presses and/or duration of pressing the button may be used to differentiate between and invoke the different functions of the button. For example, the waking of the base may be effected by pressing the button 1210 a single time. A pairing function may be invoked by pressing and holding the button 1210 down for a predetermined period of time (e.g., at least 3 seconds). Different other function may be invoked by different other number of button presses or sequence thereof. As previously described, when the base is in sleep mode, the U/I may exist in a state in which the status indicator(s) are off (e.g., state 1302 of FIG. 13). Upon waking of the base, the processor determines if the base had previously been connected (see block 1604), and if the answer is Yes, the base proceed to attempt to locate the external device associated with the previously established connection (see block 1606), during which time the U/I exists in the "connecting/pairing" state, (e.g., state 1306 of FIG. 13). If the device is available, the connection with this device is re-established, and the U/I shifts to the appropriate state, e.g., state 1308.

If the base has not been previously connected (e.g., a determination of No at block 1604), the base transitions to the "awake but not connected" mode (see block 1610) and the pairing process 1600 may be invoked. As previously described, when the base is in the "awake but not connected" mode, the U/I may exist in the associated state, e.g., as shown in block 1623, in which the status light is On but has different color than when the base is connected (e.g., a solid white light vs. a solid blue light as shown in block 1627). Similarly, if the outcome of block 1606 is unsuccessful, e.g., the base is unable to locate the device to which a connection was previously established, the base similarly transitions to the "awake but not connected" mode as shown in block 1610, and the pairing process 1600 may be initiate for pairing the base with another device. Thus, the pairing process 1600 may be used when pairing for the first time or to reset the connection to a new device/pairing. To initiate the pairing process 1600 from the "awake but not connected" state, the user may press the button 1210. In some embodiments, pressing the button 1210 once while in "awake but not connected" mode invokes the pairing process. In other embodiments, to invoke the pairing process a different number and/or manner of button presses is used, e.g., pressing the button and holding it down of a set period of time (e.g., 3 seconds, 4, second, 5 seconds or more). In yet other embodiments, a dedicated button for invoking the pairing function may be provided. Operation of the button in the manner associated with the pairing function causes the base to become discoverable (see block 1612). Pressing the button again while in pairing mode causes the base to exit pairing mode. When establishing connection with a new device, the user may additionally provide input to the device to be connected to, e.g., to confirm that the connection should be accepted/established (e.g., as shown in block 1614. Prior to confirming the connection at block 1614, the user device displays the available connection (see block 1611) to enable the user to select/confirm the paring. If the connection is confirmed (see Yes arrow), the base is successfully paired with the device (block 1608), the U/I of the base shifts to the corresponding state (see e.g., e.g., state 1308), and optionally a confirmation of the pairing is provided on the display of the user's device (see block 1609). If the connection is rejected (see No arrow from block 1614), the base returns to the awake but not connected state and if the base remains in this state for the predetermined inactivity period (see block 1618), the base returns to sleep mode.

Figure 17:
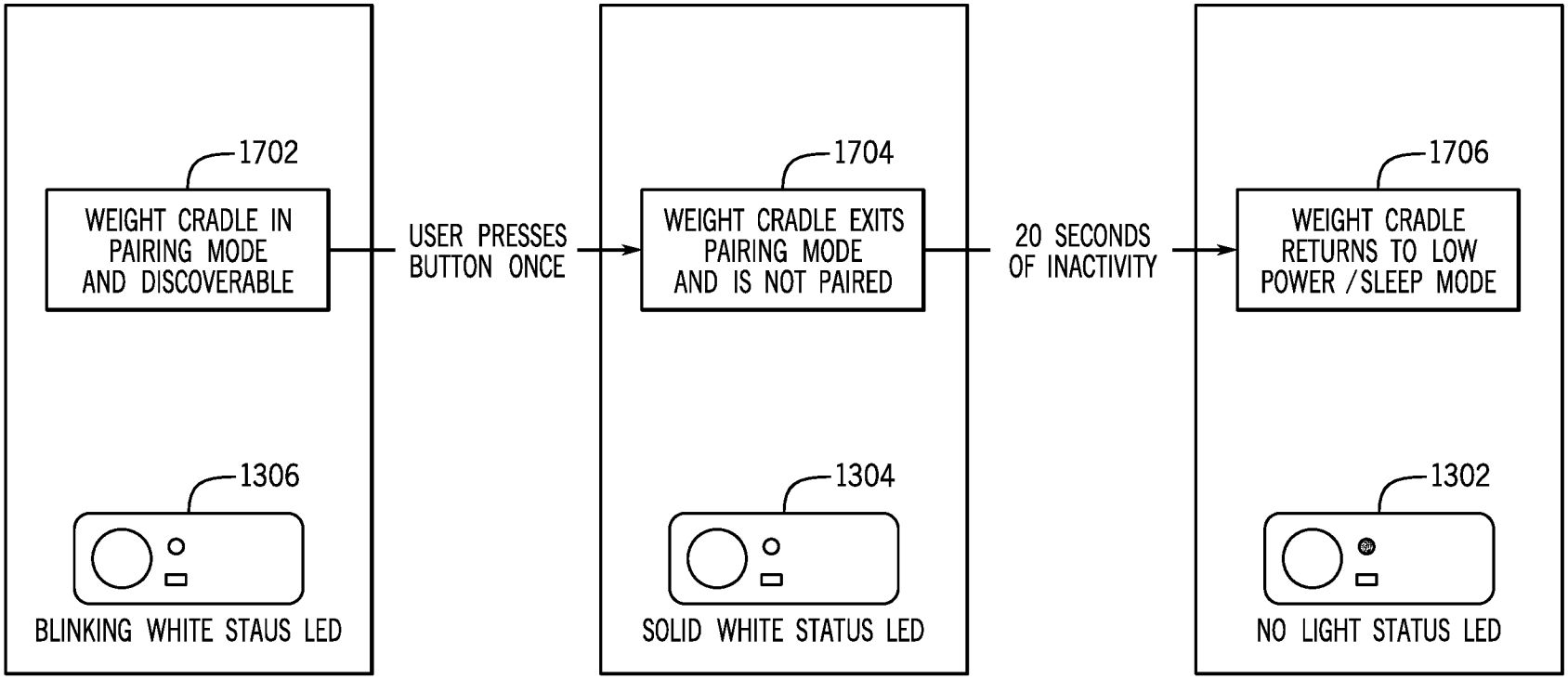
FIG. 17 shows a flow diagram of a fourth process associated with the user interface of FIG. 12.

FIG. 17 shows a flow diagram of state transitions from connecting/pairing mode to low power (or sleep) mode. In some instances, the user may decide to exit the connecting/pairing mode before it times out. For example, if the base is in the connecting/pairing mode (block 1702), the user may manipulate the button in a predetermined matter (e.g., press the button once while in pairing mode) to cancel pairing. The base 201 exits pairing mode, as shown in block 1704 and transitions to the "awake but not connected" mode, with the U/I shifting to the associated state (e.g., state 1304 of FIG. 13). The base remains in this mode until it times out after a predetermined period of inactivity (e.g., after 20 seconds) unless another action is taken. If no action is taken and the base remains inactive for the predetermined inactivity period, the base transitions to the sleep mode (see block 1706) and the U/I shift to the associated state (e.g., state 1302).

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

The invention claimed is:

1. A base for an adjustable free weight having a handle and a plurality of weight plates selectively removably attached to the handle, the base comprising:

a cradle configured to support the adjustable free weight when not in use, wherein the cradle defines a plurality of plate wells, each of which is configured to accommodate an individual one of the plurality of weight plates; and a plate-sensing assembly attached to the cradle, the plate sensing assembly comprising a plurality of rigid members, each including a plunger, wherein each of the plurality of rigid members is movably coupled to the cradle to move between a first position and a second position in which the plunger protrudes into a respective plate well by a smaller amount than when the rigid member is in the first position, the plate-sensing assembly further comprising a corresponding plurality of sensors, each associated with a respective rigid member whereby movement of the rigid member changes a state of the sensor, and at least one circuit configured to generate one or more signals indicative of the states of the plurality of sensors and to transmit the one or more signals to a processor for determining a weight of the adjustable free weight when removed from the base.

2. The base of claim 1, wherein each of the plurality of rigid members is biased toward its first position.

3. The base of claim 2, wherein each of the plurality of rigid members comprises a lever pivotally coupled to the cradle.

4. The base of claim 3, wherein the plate-sensing assembly further comprises a support structure coupled to an underside of the cradle, and wherein each of the levers comprises an axle transversely oriented relative to a lengthwise direction of the lever and rotatably received in a corresponding channel defined by the support structure.

5. The base of claim 3, wherein each of the levers further comprises a spring housing aligned with the plunger and configured to accommodate at least a portion of a spring biasing the lever towards its first position.

6. The base of claim 5, wherein the plunger, the axle and the spring housing of each lever is integrally formed with the lever.

7. The base of claim 1, wherein each of the plurality of sensors is a hall effect sensor, and wherein the base further comprises a corresponding plurality of magnets, each fixed to a respective one of the plurality of rigid members to move, with the respective rigid member, between the the first position and the second position.

8. The base of claim 7, wherein each of the hall effect sensors are positioned to generate higher output voltage when a corresponding rigid member is in its first position.

9. The base claim 1, wherein each of the plurality of sensors is an optical interrupt sensor comprising a light source and an optical receiver positioned on opposite sides of a respective rigid member to form a beam path between the light source and the optical receiver, and wherein each of the plurality of rigid members comprises a second portion that extends to a location in the beam path when the rigid member is in either the first position or the second position.

10. The base of claim 9, wherein the first portion extends from the rigid member in a first direction into a respective plate well, and wherein the second portion extends from the rigid member in a second direction substantially perpendicular to the first direction.

11. The base of claim 1, wherein each of the plurality of sensors is an optical sensor comprising a light source configured to transmit a beam along a beam path and wherein a second portion of the rigid member extends into the beam path when the rigid member is in either the first position or the second position, the optical sensor further comprising a receiver located on a same side of the rigid member as the light source.

12. The base claim 1, wherein each of the plurality of sensors comprises a resistor and wherein each of the plurality of rigid member is formed of an electrically conductive material and is arranged to make contact with an electrical contact of the respective resistor when the rigid member is in the first position.

13. The base of claim 1 further comprising a switch configured to activate a sensing function of the base.

14. The base of claim 13, wherein the switch is operatively coupled to at least one of: a button configured for actuation by a user; and an activation member configured to be automatically actuated by removal of the handle from the base.

15. The base of claim 14, wherein the activation member comprises a pivoting lever positioned below an underside of the cradle and penetrating, through an opening of the cradle, to a user-facing side of the cradle.

16. The base of claim 15, wherein the pivoting lever is a first pivoting lever biased by a spring towards the user-facing side of the cradle, the activation member further comprising a second pivoting lever between the spring and the first pivoting lever.

17. The base of claim 14 further comprising a user interface including at least one of the button and a status light configured to indicate a status of the base.

18. The base of claim 17, wherein the status light is configured to indicate at least one of an operational mode of the base, a pairing status of the base, and a power level of the base.

19. The base of claim 14, wherein the base comprises a wireless communication interface operatively associated with the button for selectively pairing the base with an external computing device separate from the base and the adjustable free weight.

20. An adjustable free weight system comprising:

an adjustable dumbbell having a handle and a plurality of weight plates selectively removably attached to the handle; and a base comprising:

a cradle configured to support the handle and the plurality of weight plates when not in use, wherein the cradle defines a plurality of plate wells, each of which is configured to accommodate an individual one of the plurality of weight plates;

a sensing assembly attached to the cradle and comprising a plurality of pivoting levers, each having a plunger that protrudes into a respective one of the plurality of plate wells, a corresponding number of sensors, each operatively arranged to interact with a respective lever, and a circuit configured to detect a change in a state of each of the plurality of sensors in response to movement of one or more of the plurality of levers and to generate one or more signals indicative of the state of the plurality of the sensors; and at least one processor configured to determine, based on the one or more signals, a total weight of the adjustable dumbbell upon removal of the handle from the base.

21. The adjustable free weight system of claim 20, wherein each of the plurality of sensors is a hall effect sensor or an optical sensor.

* * * * *